US006744994B2

(12) United States Patent
Yoshikawa et al.

(10) Patent No.: US 6,744,994 B2
(45) Date of Patent: Jun. 1, 2004

(54) IMAGE FORMING APPARATUS WITH ENVIRONMENTALLY-CONTROLLED FIRST AND SECOND CHARGING MEMBERS

(75) Inventors: Tadanobu Yoshikawa, Toride (JP); Yasunari Watanabe, Shizuoka-ken (JP); Motoki Adachi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/233,507

(22) Filed: Sep. 4, 2002

(65) Prior Publication Data

US 2003/0147659 A1 Aug. 7, 2003

(30) Foreign Application Priority Data

Sep. 4, 2001 (JP) ..... 2001-266718
Aug. 7, 2002 (JP) ..... 2002-229807

(51) Int. Cl.[7] ..... G03G 15/00; G03G 21/00

(52) U.S. Cl. ..... 399/44; 399/71; 399/129; 399/150; 399/343

(58) Field of Search ..... 399/149, 150, 399/127, 128, 129, 44, 47, 71, 94, 97, 343, 349, 354, 98, 99; 430/125

(56) References Cited

U.S. PATENT DOCUMENTS 5,066,982 A * 11/1991 Hosoya et al. ..... 399/150
5,323,215 A * 6/1994 Ohtaka et al. ..... 399/150 X
5,862,432 A * 1/1999 Nakayama et al. ..... 399/44
6,421,512 B2 7/2002 Watanabe et al. ..... 399/149
2002/0057925 A1 * 5/2002 Watanabe et al. ..... 399/129
2003/0049048 A1 * 3/2003 Yoshikawa et al. ..... 399/129
2003/0059231 A1 * 3/2003 Watanabe et al. ..... 399/129

FOREIGN PATENT DOCUMENTS

JP 04-086880 * 3/1992
JP 2002-099176 * 4/2002

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member, a first charging member for charging a residual developer on the image bearing member, a second charging member for charging the residual developer, an environmental condition detector, and a controller. The first charging member is disposed downstream of the transferring device and up stream of the charger, with respect to a movement direction of the image bearing member. A voltage having a polarity opposite to a polarity of the developer is applied to the first charging member. The second charging member is disposed downstream of the first charging member and upstream of the charger. A voltage having a polarity like a polarity of the developer is applied to the second charging member. The controller, in accordance with an output of the detector, controls at least one of the voltages applied to the first and second charging members.

27 Claims, 7 Drawing Sheets

IMAGE FORMING APPARATUS WITH ENVIRONMENTALLY-CONTROLLED FIRST AND SECOND CHARGING MEMBERS

FIELD OF THE INVENTION AND RELATED ART

The present invention relates to an image forming apparatus equipped with a developer charging member for charging the developer remaining on an image bearing member, and is suitable for a cleaner-less image forming apparatus, that is, an image forming apparatus which does not have a dedicated cleaner. In particular, it relates to a cleaner-less image forming apparatus, in which the developer (toner) remaining on an image bearing member after the image transfer process is removed (recovered) from the image bearing member by the developing apparatus so that the recovered developer can be reused.

Heretofore, an electrophotographic image forming apparatus of a transfer type, such as a copying machine a printer, a facsimile, etc., comprises: a photoconductive member as an image bearing member which usually is in the form of a drum; a charging apparatus (charging process) for uniformly charging the photoconductive drum to predetermined polarity and potential level; an exposing apparatus (exposing process) as an information writing means for forming an electrostatic latent image on the charged photoconductive member; a developing apparatus (developing process) for visualizing the electrostatic latent image formed on the photoconductive member with the use of toner as developer; a transferring apparatus (transferring process) for transferring the toner image from the surface of the photoconductive drum onto transfer medium, for example, a piece of paper; a cleaning apparatus (cleaning process) for cleaning the surface of the photoconductive drum by removing the toner remaining, by a certain amount, on the surface of the photoconductive drum; a fixing apparatus (fixing process) for fixing the toner image on the transfer medium; and so forth. The photoconductive member is repeatedly subjected to an electrophotographic processes (charging, exposing, developing, transferring, and cleaning processes) to form images.

The toner remaining on the photoconductive drum after the transferring process is removed from the surface of the photoconductive drum by the cleaning apparatus, and collected as waste toner in the cleaning apparatus. From the standpoint of environmental preservation, effective utilization of natural resources, and so on, it is desired that waste toner such as the above described one is not generated.

Thus, there has been developed an image forming apparatus in which the untransferred residual toner, or the so-called waste toner collected in the cleaning apparatus, is returned to the developing apparatus to be reused.

There has also been developed a cleaner-less image forming apparatus which does not have a dedicated cleaning apparatus, and in which the untransferred residual toner, or the toner remaining on the photoconductive drum after the transferring process, is removed from the photoconductive drum by the developing apparatus to be reused, at the same time as an electrostatic latent image on the photoconductive drum is developed by the developing apparatus (developing/cleaning process).

The elimination of the dedicated cleaning system makes it possible to reduce image forming apparatus size and simplify an Image forming apparatus. Further, the lack of a dedicated cleaning member means that there is no rubbing of the surface of the photoconductive drum by the cleaning member, lengthening the service life of the photoconductive drum. In other words, the elimination of the dedicated cleaning system offers substantial merits.

The developing/cleaning process is a process in which the toner remaining on the photoconductive drum after the image transfer is recovered by the developing apparatus during the following developing process. More specifically, after the image transfer, the area of the photoconductive drum, from which the toner image has been transferred, is charged, and then, is exposed to form an electrostatic latent image thereon. Then, the untransferred residual toner on the portions of the peripheral surface of the photoconductive member (non-image portions), to which toner is not to be adhered, is recovered into the developing apparatus, by the fog prevention bias (difference Vback in potential level between DC voltage applied to developing apparatus, and the surface potential level of photoconductive drum. According to this method, the untransferred residual toner is recovered into the developing apparatus and is reused for developing electrostatic latent image in the following image formation cycles. In other words, no toner is wasted.

Therefore, a user does not need to be bothered by the waste toner.

Further, having no dedicated cleaner is advantageous from the standpoint of image forming apparatus size reduction. Since the untransferred residual toner on the photoconductive drum is recovered by the developing apparatus, it is desired that a reversal developing method, that is, a developing method in which the polarity to which the photoconductive drum is charged is the same as the normal polarity to which toner is charged, is employed.

However, if a cleaner-less image forming apparatus such as the above described one which recovers (removes) the transfer residual toner remaining on the photoconductive drum after image transfer, and reuse it, is such an image forming apparatus that employs a contact charging apparatus which charges the surface of the photoconductive member by making contact with the photoconductive member, the toner particles in the untransferred residual toner, the polarity of which have been made opposite to the normal polarity to which the toner becomes charged, adhere to the contact charging apparatus while the transfer residual toner on the photoconductive member passes the charging station, that is, the contact nip between the photoconductive member and contact charging apparatus, contaminating the contact charging apparatus beyond the tolerable range. As a result, the photoconductive member is unsatisfactorily charged.

More specifically, normally, the toner as developer contains a certain amount of toner particles, the polarity of which is opposite to the normal toner polarity, although the amount is relatively small. Further, some of the toner particles with the normal polarity are reversed in polarity, or reduced in the amount of charge, by the transfer bias, the electrical discharge from the recording medium separation, etc.

Thus, the untransferred residual toner contains the toner particles with the normal polarity, toner particles with the reverse polarity, and toner particles with a smaller amount of electrical charge Among these three types of toner particles, the toner particles with the reverse polarity and the toner particles with reduced electrical charge are likely to adhere to the contact charging apparatus while they are moving through the charging station, or the contact nip between the photoconductive drum and contact charging apparatus.

Further, in order to remove and recover the untransferred residual toner on the photoconductive drum (in order to clean the photoconductive drum) by the developing apparatus at the same time as a latent image on the photoconductive drum is developed by the developing apparatus, it is necessary that the toner particles in the untransferred residual toner on the photoconductive drum, which are being carried to the developing station through the charging station, are normal in polarity (for example, negative), and also that the amount of electrical charge they are holding is proper for them to be used by the developing apparatus to satisfactorily develop the electrostatic latent image on the photoconductive drum. The toner particles with the reverse polarity (for example, positive polarity) and the toner particles improper in the amount of electrical charge cannot be removed and recovered from the photoconductive drum by the developing apparatus, effecting unsatisfactory images.

An image defect traceable to the failed recovery of the positively charged toner particles by the developing apparatus is called a positive ghost, which is a problem peculiar to an image forming apparatus without a dedicated cleaning member. More specifically, without a dedicated cleaning member, the untransferred residual toner reaches the developing station past the charging member, while remaining distributed in the pattern of the electrostatic latent image. If the untransferred residual toner particles are satisfactorily removed, in the developing station, from the photoconductive drum by the developing apparatus while the next electrostatic latent image is developed by the developing apparatus, the pattern in which the untransferred residual toner particles are distributed is eliminated. However, if the residual toner particles fall to be satisfactorily removed, the pattern which the residual toner particles are distributed is not completely eliminated and appears across a transfer medium, overlapping with the following toner image, as the following toner image is transferred onto the transfer medium. As a result, the portions of the following toner image corresponding to the residual toner pattern appear darker; in other words, a ghost appears. Since this ghost is darker than the surrounding area, it is called a positive ghost.

The above described adhesion of the toner particles to the contact charging apparatus can be prevented by charging the untransferred residual toner, that is, a mixture of the toner particles with the normal polarity, toner particles with the reversal polarity, and toner particles with reduced electrical charge, with the use of means for controlling the electrical charge of the untransferred residual toner particles in polarity as well as amount, so that so that all the toner particles in the residual toner become normally charged, and uniform in the amount of electrical charge.

However, as the residual toner particles are charged by the toner charge controlling means in order to prevent them from adhering to the contact charging apparatus, the amount of the electrical charge of the residual toner particles becomes greater than the proper amount of electrical charge for the satisfactory development of the electrostatic latent image on the photoconductive drum, making it difficult for the residual toner particles to be removed and recovered by the developing apparatus in the developing station, at the same time as the developing process is carried out by the developing apparatus. As a result, some of the toner particles in the residual toner remain on the photoconductive drum and are transferred onto a recording medium, effecting image defects, as the following toner image is transferred onto the recording medium.

Further, in recent years, the user needs have diversified. As a result, the demand for an image forming apparatus capable of continuously forming images with a high printing ratio, such as photographic images, an image forming apparatus capable of forming color images with the use of a multilayer developing method or the like, and the like image forming apparatuses, has increased. In the case of such image forming apparatuses, a large amount of the residual toner is generated all at once, exacerbating the above described problems.

This problem can be solved by providing a cleaner-less image forming apparatus with a residual toner particle uniformizing means (first developer charging member) and a toner charge amount controlling means (second developer charging means), and applying predetermined DC voltages to the two means. The residual toner particle uniformizing means is a means for making uniform in polarity the transfer residual toner particles remaining on the photoconductive drum after the transfer of the toner image on the photoconductive drum, whereas the toner charge amount controlling means is a means for charging the residual toner particles on the photoconductive drum. In terms of the rotational direction of the photoconductive drum, the residual toner particle uniformizing means is positioned on the upstream side of the contact charging apparatus and on the downstream side of the transferring means, whereas the toner charge amount controlling means is positioned on the down stream side of the residual toner uniformizing means and on the upstream side of the contact charging apparatus. The details of this solution is disclosed in U.S. Pat. No. 6,421,512.

More concretely, the residual toner particles remaining on the photoconductive drum after the toner image transfer are uniformized by the residual toner uniformizing means, and then, the uniformized residual toner particles on the photoconductive drum are charged to the normal polarity by the toner charge amount controlling means. Thereafter, at the same time as the surface of the photoconductive drum is charged in the charging station by the contact charging apparatus, the residual toner particles are charged by the contact charging apparatus to the proper potential level for the toner particles to be removed and recovered from the photoconductive drum by the developing apparatus in the developing station at the same time as the developing process is carried out by the developing apparatus in the developing station. Then, the properly charged residual toner particles are recovered by the developing apparatus in the developing station.

To describe in more detail, the image forming apparatus is provided with two stationary brush, as the first (upstream) and second (upstream) developer charging members, which are disposed on the downstream side of the transferring means and on the upstream side of the charging means. To the first developer charging member, positive DC voltage (positive bias) is applied, whereas to the second developer charging member, negative DC voltage (negative bias) is applied. The negatively charged toner particles on the photoconductive member are absorbed by the first developer charging member, being thereby positively charged. As the amount of the negatively charged toner particles in the first developer charging member reaches the toner particle holding capacity of the first developer charging member, the toner particles in the first developer charging member are gradually expelled as positively charged toner particles, back onto the photoconductive member. Thus, all the residual toner particles on the area of the peripheral surface of the photoconductive member on the immediately downstream side of the first developer charging member have positive electrical charge. Then, all the charged residual toner particles on this area of the peripheral surface of the photoconductive member are efficiently charged to the negative polarity by the second developer charging member, since all the residual toner particles on this area have been positively charged by the first developer charging member. As a result, the residual toner particles are prevented from adhering to the charging means (charge roller).

Further, oscillatory voltage, more specifically, a combination of DC voltage and AC voltage, is applied to the charging means. Therefore, the electrical charge of the residual toner particles, which is relatively high in potential level after being charged by the second developer charging member, is removed by a certain amount by the charging means. As a result, the potential level of the residual toner particles reduces to the potential level (close to proper level for satisfactory development) at which the residual toner particles can be easily recovered by the developing apparatus, improving thereby the efficiency with which the residual toner particles are recovered by the developing apparatus.

However, the amount by which electrical charge is given to the residual toner particles remaining on the photoconductive drum after the toner image transfer significantly affected by the conditions of the environment in which an image forming apparatus is used, printing ratio, etc. Therefore, if the DC voltages applied to the first and second developer charging members are kept constant, the residual toner particles sometimes fails to be charged to the proper potential level for them to be removed and recovered by the developing apparatus. In such a case, the residual toner particles remaining on the photoconductive drum, that is, the toner particles which could not be removed and recovered by the developing apparatus, are transferred onto a transfer medium, effecting image defects, as a toner image is transferred onto the transfer medium.

Next, the phenomenon that the amount by which electrical charge is given to the residual toner particles is affected by the conditions of the environment in which an image forming apparatus is operated will be described in more detail. The electrical resistance of an electrically conductive brush or the like, which is used as a developer charging member, is greatly affected by the environmental conditions.

Therefore, the value of the bias applied to the electrically conductive brush or the like, as the developer charging member, is kept constant, the toner particles are not given the proper amount of electrical charge.

In other words, a) In a low humidity/low temperature environment (L/L (15° C., 10% RH) environment), the electrical resistance of the developer charging member increases, reducing thereby the amount by which electrical charge is given to the residual toner by the developer charging member (reduction in charging performance). In the case of the first developer charging member, the amount of the force by which the first developer charging member attracts the residual toner, and the amount by which the first developer charging member can hold the residual toner particles, reduce, allowing a larger amount of the residual toner particles to reach and enter the second developer charging member, contact charging member, and developing apparatus, resulting in the generation of ghosts, and/or the contamination of the contact charging member. Further, the second developer charging member falls to give the proper amount of electrical charge to the residual toner particles, which results in the contamination of the contact charging member.

B) In a high humidity/high temperature environment (H/H (30° C., 80% RH) environment), the electrical resistance or the developer charging member decreases, allowing an excessive amount of electrical current to flow. Therefore, the amount by which electrical charge is given to the residual toner by the developer charging member is substantially increased (enhancement in charging performance). As a result, not only is the residual toner particles are given a large amount of electrical charge, but also the photoconductive drum is given a large amount of electrical charge; in other words, the first developer charging member injects an excessive amount of positive electrical charge into the photoconductive drum, effecting thereby image defects such as the negative ghosts, brush streaks, etc. Each of these image defects occurs because the photoconductive drum is charged to the polarity (positive polarity) opposite to the polarity to which the photoconductive drum is normally charged. On the contrary, in the case of the second developer charging member, it gives an excessive amount of negative electrical charge. Therefore, as the residual toner particles are charged by the contact charging member on the downstream side of the developer charging members, they fail to be uniformly charged; all the transfer particles are not charged to the predetermined level.

SUMMARY OF THE INVENTION

The primary object of the present invention is to provide an image forming apparatus in which all the transfer residual developer particles on the image bearing member are given proper electrical charge.

Another object of the present invention is to provide an image forming apparatus in which all the transfer residual developer particles on the image bearing member are given a proper amount of electrical charge regardless of the conditions of the environment in which the image forming apparatus is used.

Another object of the present invention is to provide an image forming apparatus compatible with a cleaner-less system, that is, a system lacking a dedicated cleaning means.

Another object of the present invention is to provide an image forming apparatus in which all the transfer residual developer particles are efficiently recovered by the developing means.

Another object of the present invention is to provide an image forming apparatus in which the transfer residual developer particles remaining on the image bearing member after image transfer do not cause the image bearing member to be unsatisfactorily charged, and also, do not cause image defects.

Another object of the present invention is to provide an image forming apparatus in which the pattern of the image formed on the image bearing member during the preceding image forming cycle of the image bearing member does not appear on the image bearing member during the following image forming cycle of the image bearing member.

These and other objects, features and advantages of the present invention will become more apparent upon consideration of the following description of the preferred embodiments of the present invention, taken in conjunction with the accompanying drawings.

DESCRIPTION OF THE PREFERRED EMBODIMENTS (Embodiment 1)

Hereinafter, the image forming apparatuses (image recording apparatuses) in accordance with the present invention will be described.

Figure 1:
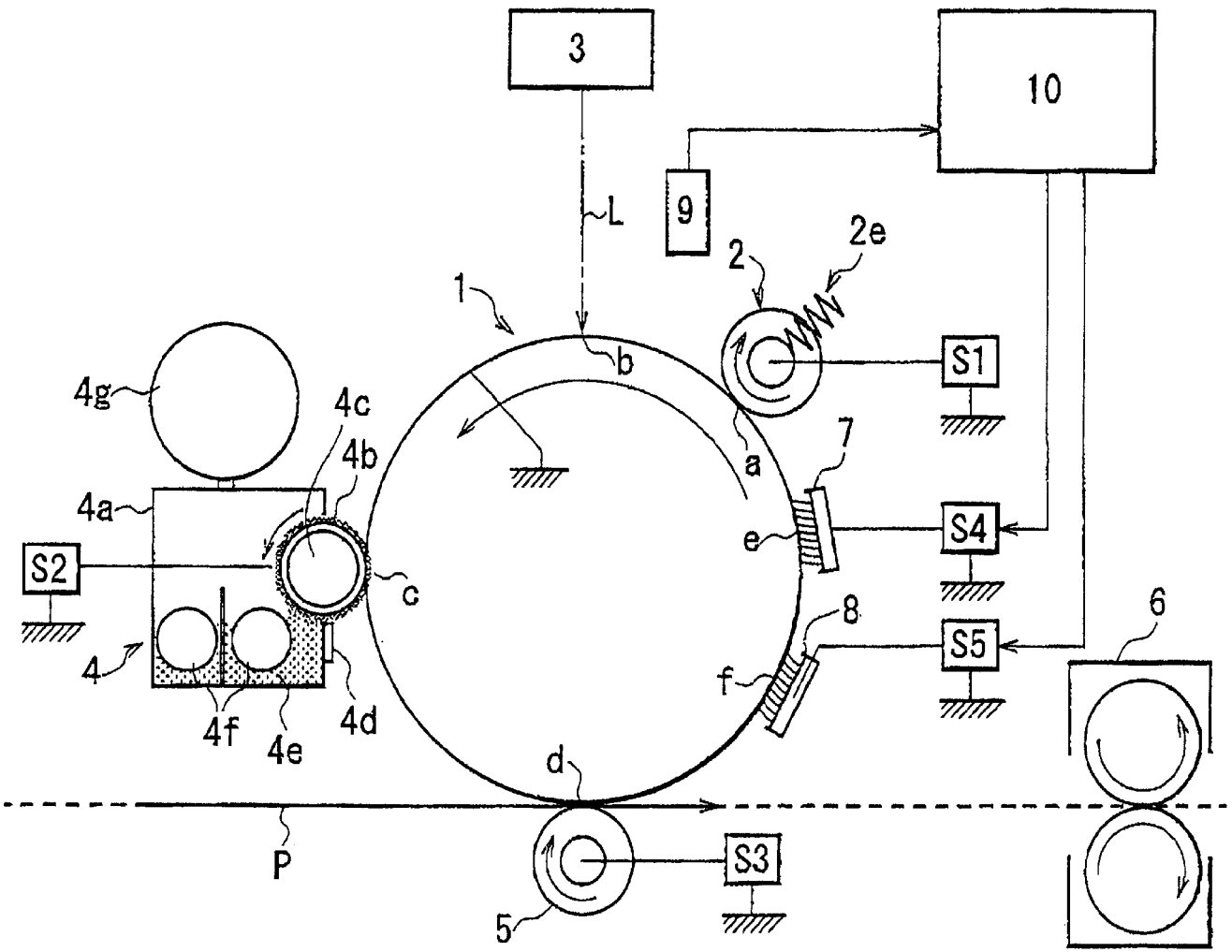
FIG. 1 is a schematic drawing of the image forming apparatus in the first embodiment of the present invention, for showing the general structure thereof.

FIG. 1 is a schematic drawing of an example of an image forming apparatus in accordance with the present invention, for showing the general structure thereof. This example of an image forming apparatus is an electrophotographic laser beam printer employing a contact charging method, a reversal developing method, and a cleaning system without a dedicated cleaning means. The maximum size of the transfer medium usable with this image forming apparatus is A3.

(1) General Structure of printer (a) Image Bearing Member

Designated by a reference numeral 1 is an electrophotographic photoconductive member in the form of a rotational drum (which hereinafter will be referred to as photoconductive drum). This photoconductive drum 1 is a negatively chargeable organic photoconductor (OPC). It is 60 mm in external diameter, and is rotationally driven about the axial line of the photoconductive drum supporting shaft, at a process speed (peripheral speed) of 100 mm/sec in the counterclockwise direction indicated by an arrow mark.

Figure 2:
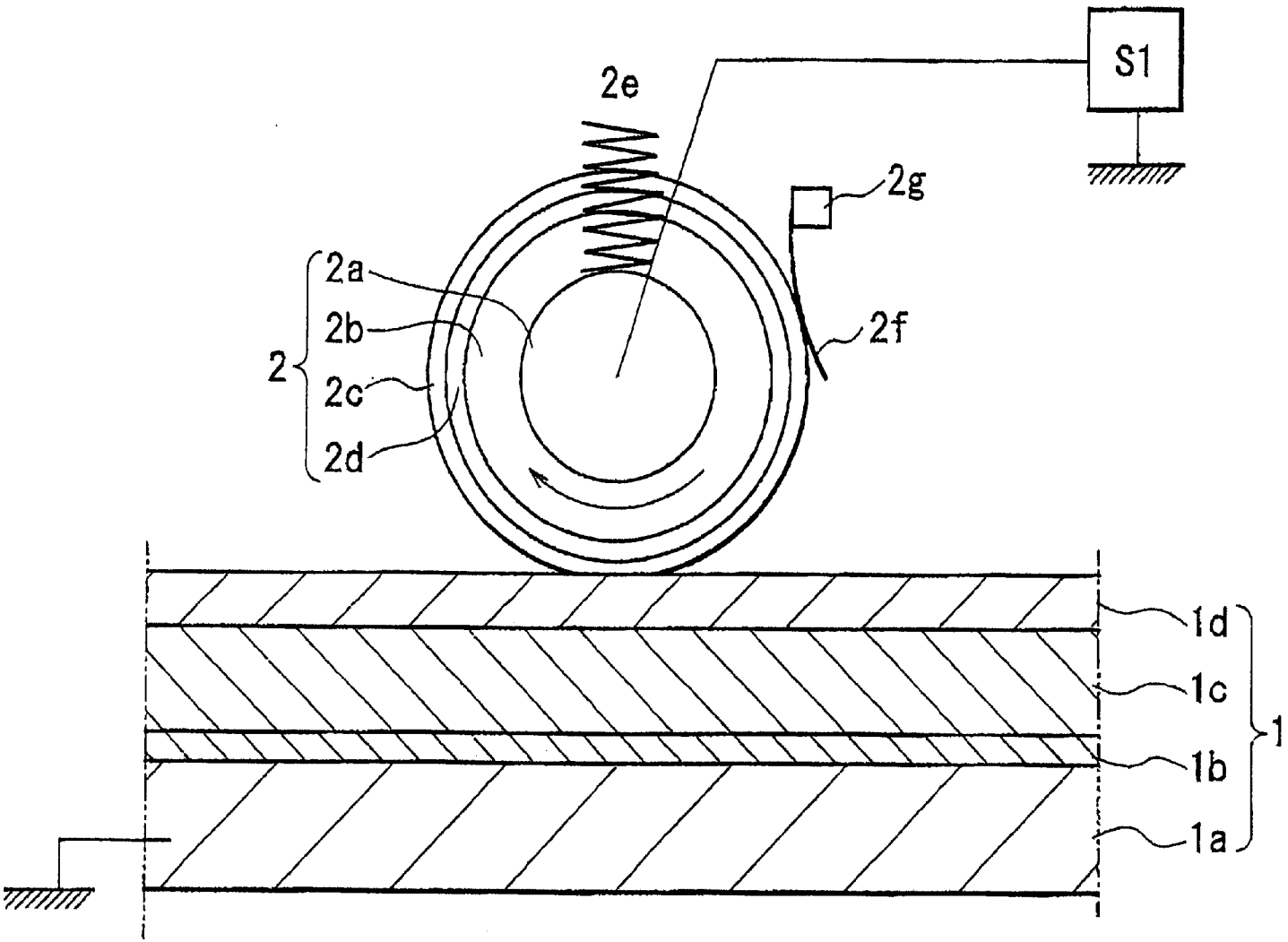
FIG. 2 is a schematic drawing of the combination of the photoconductive drum and charging roller, for showing the laminar structure of the charge roller.
Figure 3:
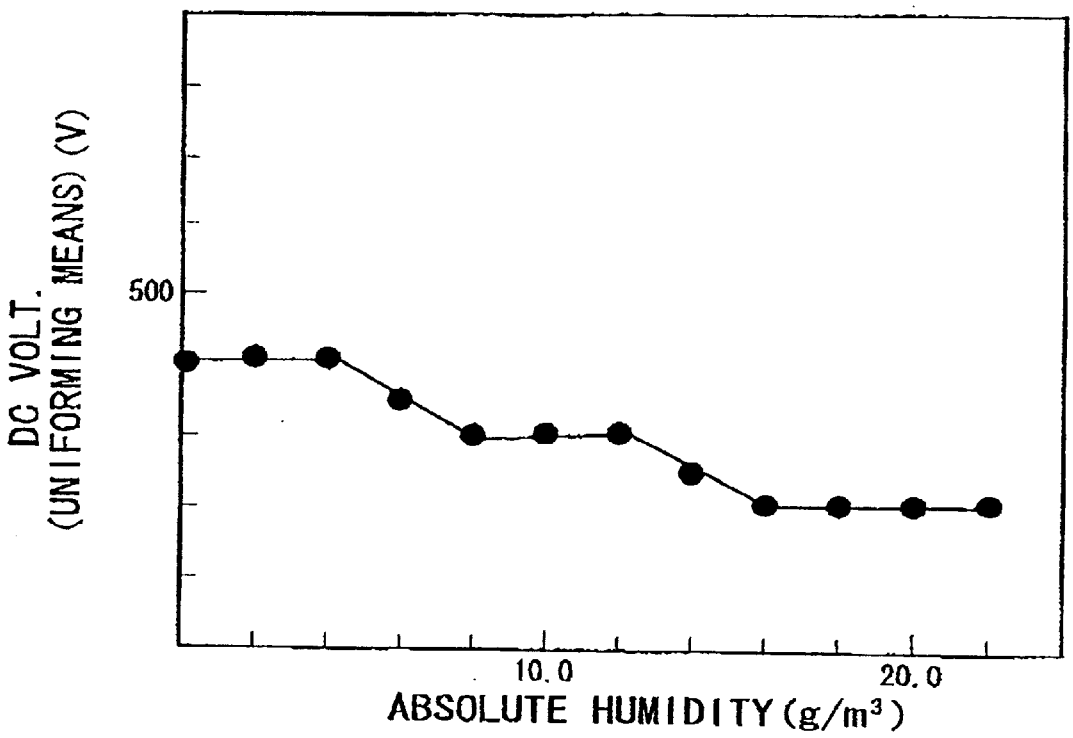
FIG. 3 is a graph for showing the relationship between the absolute humidity in the environment in which the image forming apparatus is used, and the DC voltage applied to the transfer residual toner uniformizing means.

Referring to FIG. 2, which schematically shows the laminar structure of the photoconductive drum 1, the photoconductive drum 1 comprises an aluminum cylinder 1*a* (electrically conductive base member), and three functional layers coated in layers on the peripheral surface of the electrically conductive base member 1*a*. The three layers are an undercoat layer 1*b*, an electrical charge generating layer 1*c*, and an electrical charge transferring layer 1*d*, listing from the layer closest to the aluminum cylinder 1*a*. The undercoat layer 1*b* is for suppressing optical interferences and improving the fixation of the layer thereupon to the base member 1*a*.

(b) Charging Means

Designated by a reference numeral 2 is a contact charging apparatus (contact charging device) as a charging means for uniformly charging the peripheral surface of the photoconductive drum 1. In this embodiment, the charging means is a charge roller (roller type charging device).

The charge roller 2 is rotationally supported by an unshown pair of bearing members, by the lengthwise end portions of its metallic core 2*a*, and is kept pressured toward the photoconductive drum 1 by a pair or compression coil springs 2*e* so that its peripheral surface is kept pressed upon the peripheral surface of the photoconductive drum 1 in a manner to generate a predetermined amount of contact pressure. The charge roller 2 is rotated by the rotation of the photoconductive drum 1. The contact nip between the photoconductive drum 1 and charge roller 2 constitutes the charging station a (charging nip).

To the metallic core 2*a* of the charge roller 2, charge bias, or voltage, which satisfies predetermined requirements, is applied from an electrical power sourge S1, so that as the photoconductive drum 1 is rotated, the peripheral surface of the photoconductive drum 1 is charged to predetermined polarity and potential level. In this embodiment, the charge voltage, as the charge bias, applied to the charge roller 2 is an oscillatory voltage, that is, a combination of DC (Vdc) and AC voltages. More specifically, it is the combination of DC voltage of −500 V, and AC voltage, which is 1 kHz and 1.5 kV in frequency f and peak-to-peak voltage Vpp, respectively, and has a sinusoidal waveform. With the application of this oscillatory voltage to the charge roller 2, the peripheral surface of the photoconductive drum 1 is uniformly charged to −500 V (dark (unilluminated) area voltage Vd).

Referring to FIG. 2, which is a schematic drawing for showing the laminar structure of the charge roller 2, the charge roller 2 is 330 mm in length, and comprises the aforementioned metallic core 2*a* (supporting member), and three layers, that is, an undercoat layer 2*b*, an intermediary layer 2*c*, and a surface layer 2*d*, which are placed in layers on the peripheral surface of the metallic core 2*a*, in the listed order. The undercoat layer 2*b* is for reducing the charging noises, and is formed of foamed substance such as sponge. The surface layer 2*d* is a protective layer provided for preventing electrical leak even if the peripheral surface of the photoconductive drum 1 has defects such as pin holes.

More specifically, the specification of the charge roller 2 in this embodiment is as follows:

a. metallic core 2*a*: a piece of stainless steel rod with a diameter of 6 mm;

b. undercoat layer 2*b*: formed of foamed EPDM in which carbon has been dispersed; 0.5 g/cm$^3$ in specific gravity $10^2$–$10^9$ Ωcm in volumetric resistivity value; 3.0 mm in thickness, and 320 mm in length;

c. intermediary layer 2*c*: formed of NBR in which carbon has been dispersed; $10^2$–$10^6$ Ωcm in volumetric resistivity value; and 700 μm in thickness; and d. surface layer 2*d*: formed of Toresin resin, a fluorinated compound, in which tin oxide and carbon have been dispersed; $10^7$–$10^{10}$ Ωcm in volumetric resistivity value; 1.5 μm in surface roughness (10 point average surface roughness Ra in JIS); and 10 μm in thickness.

Referring to FIG. 2, a reference numeral 2*f* stands for a charge roller cleaning member. In this embodiment, the charge roller cleaning member is a piece of flexible film. This cleaning film 2*f* is disposed in parallel to the lengthwise direction of the charge roller 2, and is fixed, by one of its long edges, to a supporting member 2*g* which oscillates a predetermined distance in the direction also parallel to the lengthwise direction of the charge roller 2. Further, the cleaning film 2*f* is positioned so that its portion adjacent to its free edge, that is, the edge by which it is fixed to the supporting member 2*g*, forms a contact nip against the peripheral surface of the charge roller 2. The supporting member 2*g* is driven by a driving motor of the printer through a gear train so that it is oscillated by the predetermined distance in its lengthwise direction. As a result, the surface layer 2*d* of the charge roller 2 is rubbed by the cleaning film 2*f*. By this action of the cleaning film 2*f*, the contaminants (microscopic toner particles, additives, and the like) adhering to the peripheral surface of the charge roller 2 are removed. The cleaning film 2*f* is formed of resin, and triboelectrically charges the toner particles on the charge roller 2 to their normal polarity (negative polarity). Having been negatively charged, the toner particles return to the photoconductive drum 1.

(c) Information Writing Means

Designated by a reference numeral 3 is an exposing apparatus as an information writing means for forming an electrostatic latent image on the peripheral surface of the charged photoconductive drum 1. In this embodiment, it is a laser beam scanner employing a semiconductor laser. The exposing apparatus 3 scans (exposes) the uniformly charged peripheral surface of the rotating photoconductive drum 1 with a scanning laser beam L which it projects while modulating the laser beam L with the image formation signals sent to the printer from an unshown host such as an image reading apparatus. This scanning (exposing) is done at an exposing point b, or exposing station. As the result of the scanning of the uniformly charged peripheral surface of the rotating photoconductive drum 1 by this laser beam L, the portions of the peripheral surface of the photoconductive drum 1 illuminated by the laser beam L are reduced in potential level, sequentially effecting an electrostatic latent image in accordance with the image formation information written on the peripheral surface of the photoconductive drum 1 by the scanning laser beam L.

(d) Developing Means

A reference numeral 4 stands for a developing apparatus (developing device) au a developing means for developing (visualizing) an electrostatic latent image on the photoconductive drum 1 into a toner image by supplying developer 4*e* to the electrostatic latent image. In this embodiment it is a reversal developing apparatus employing a two-component magnetic brush type developing method.

Designated by reference numerals 4*a* and 4*b* are a developer container and a nonmagnetic development sleeve, respectively. The development sleeve 4*b* is rotationally disposed within the developer container 4*a* with its peripheral surface partially exposed from the developer container 4*a*. Designated by reference numerals 4*c*, 4*d*, 4*e*, 4*f*, and 4*g* are a magnetic roller, a developer coating blade, a two-component developer, each of a pair of developer stirring members, and a toner hopper, respectively. The magnetic roller 4*c* is stationarily disposed within the hollow of the development sleeve 4*b*. The two-component developer 4*e* is stored in the developer container 4*a*. The developer stirring members 4*f* are positioned in the bottom portion of the developer container 4*a*. The toner hopper 4*g* contains replenishing toner.

The two-component developer 4*e* in the developer container 4*a* is a mixture of toner and magnetic carrier, and is stirred by the developer stirring members 4*f*. In this embodiment, the electrical resistance of the magnetic carrier is approximately $10^{13}$ Ωcm, and its particle diameter is 40 μm. The toner is negatively charged by the friction between the toner and magnetic carrier.

The development sleeve 4*b* is disposed in parallel to the photoconductive drum 1 so that the shortest distance (S-D gap) between the peripheral surfaces of the development sleeve 4*b* and photoconductive drum 1 is maintained at 350 μm. Where the distance between the peripheral surfaces of the development sleeve 4*b* and photoconductive drum 1 is shortest, and its adjacencies, constitute the development station c. The development sleeve 4*b* is rotationally driven in such a direction that its peripheral surface moves in the direction opposite to the peripheral surface of the photoconductive drum 1, in the development station c. A part of the two-component developer 4*e* in the developer container 4*a* is held to the peripheral surface of the development sleeve 4*b* by the magnetic force of the magnetic roller 4*c* in the development sleeve 4*b*, forming a magnetic brush layer, that is, a layer of two-component developer 4*e*. As the development sleeve 4*b* is rotated, the magnetic brush layer moves with the peripheral surface of the development sleeve 4*b*. and as it moves with the peripheral surface or the development sleeve 4*b*, its thickness is reduced by the developer coating blade 4*d* to a predetermined one, that is, the proper thickness for the magnetic brush layer to come into contact with the peripheral surface of the photoconductive drum 1 and properly rubs the peripheral surface of the photoconductive drum 1, in the development station c. To the development sleeve 4*b*, a predetermined development bias is applied from an electrical power sourge S2 in this embodiment, the development bias, or development voltage, applied to the development sleeve 4*b* is an oscillatory voltage, that is, a combination of DC (Vdc) and AC (Vac) voltages. More specifically, it is the combination of DC voltage: −350 V, and AC voltage, which is 8.0 kHz and 1.8 kV in frequency f and peak-to-peak voltage Vpp, respectively, and has a rectangular waveform.

Through the process described above, the two-component developer 4*e* is coated in a thin layer on the peripheral surface of the rotating development sleeve 4*b*, and is conveyed to the development station c, in which the toner portion of the developer 4*e* is adhered to the selected portions, that is, the portions of the peripheral surface of the photoconductive drum 1 corresponding to the pattern of the electrostatic latent image, by the electrical field generated by the development bias. As a result, the electrostatic latent image is developed into a toner image. In this embodiment, the toner adheres to the exposed portions, that is, the illuminated portions, of the peripheral surface of the photoconductive drum 1; in other words, the electrostatic latent image is developed in reverse.

The amount of the electrical charge, which the toner particles have after being adhered to the peripheral surface of the photoconductive drum 1, is −25 μC in the environment which is 23° C. in temperature, and 10.5 g/m$^3$ in absolute humidity.

As the development sleeve 4*b* is further rotated, the portion of the thin layer of the developer on the development sleeve 4*b*, which passed through the development station c, is conveyed back into the developer pocket in the developer container 4*a*.

In order to keep the toner density of the two-component developer 4*c* in the developer container 4*a* within a predetermined approximate range, the following system is provided: The toner density of the two-component developer in the developer container 4*a* is detected by an unshown toner density sensor, for example, an optical toner density sensor, and the toner hopper 4*g* is driven in response to the toner density information detected by the sensor, so that the toner within the toner hopper 4*g* is supplied to the two-component developer 4*e* within the developer container 4*a*. After being supplied to the two-component developer 4*e*, the toner is stirred by the stirring members 4*f*.

(e) Transferring Means and Fixing Means

Designated by a reference numeral 5 is a transferring apparatus. In this embodiment, the transferring apparatus 5 is a transfer roller. The transfer roller 5 is kept pressed upon the photoconductive drum 1 by the application of a predetermined amount of pressure, forming a compression nip against the peripheral surface of the photoconductive drum 1. This compression nip constitutes the transfer station d. To this transfer station d, a transfer medium p (medium onto which image is transferred; recording medium), as medium which receives a toner image, is delivered from an unshown sheet feeding mechanism with a predetermined control timing.

As the transfer medium p is delivered to the transfer station d, it is nipped between the peripheral surfaces of the photoconductive drum 1 and transfer roller 5, and is conveyed further while remaining nipped.

While the transfer medium p is conveyed through the transfer station d, being nipped by the peripheral surfaces of the photoconductive drum 1 and transfer roller 5, transfer bias with the positive polarity, which is +2 kV in this embodiment, is applied to the transfer roller 5 from an electrical power sourge S3. As a result, the toner image on the peripheral surface of the photoconductive drum 1 is transferred, electrostatically and sequentially, onto the surface of the transfer medium p, as the transfer medium p is conveyed through the transfer station d, remaining nipped by the photoconductive drum 1 and transfer roller 5. The polarity of the transfer bias, which is positive, is opposite to the normal polarity (negative polarity) to which toner particles becomes charged.

After receiving the toner image while being passed through the transfer station d, the transfer medium p is continually separated, starting from its leading end, from the peripheral surface of the photoconductive drum 1, and is conveyed to the fixing apparatus 6 (for example, heat roller type fixing apparatus), in which the toner image is fixed. Thereafter the transfer medium p is outputted as a print or copy.

(2) Cleaner-less System and Controlling or Toner Charge

The printer in this embodiment is of a cleaner-less type. In other words, it is not equipped with a cleaning apparatus dedicated to the removal of the residual toner particles, that is, a small amount of toner particles remaining on the peripheral surface of the photoconductive drum 1 after the transfer of the toner image onto the transfer medium p. Thus, after the transfer, the residual toner particles on the peripheral surface of the photoconductive drum 1 are conveyed farther by the rotation of the photoconductive drum 1 through the charging station a and exposing station b, and to the development station c, in which they are removed (recovered) by the developing apparatus 4 at the same time as the development process is carried out by the developing apparatus (cleaner-less system).

In this embodiment, the development sleeve 4*b* of the developing apparatus 4 is rotated in such a direction that in the development station c, the peripheral surface of the development sleeve 4*b* moves in the direction opposite to the peripheral surface of the photoconductive drum 1, as described before. Rotating the development sleeve 4*b* in this manner is advantageous for the recovery of the residual toner particles on the peripheral surface of the photoconductive drum 1.

Since the residual toner particles on the peripheral surface of the photoconductive drum 1 go through the exposing station b, the peripheral surface of the photoconductive drum 1 is exposed with the presence of the residual toner particles on the peripheral surface.

However, the amount of the residual toner particles is very small, and therefore, the presence of the residual toner particles does not greatly affect the exposing process, except for the following.

As described hereinbefore, in terms of polarity, the residual toner is the mixture of the normally charged (negatively charged) toner particles and reversely charged (positively charged) toner particles (reversal toner particles). Further, some of the charged toner particles have an insufficient amount of electrical charge. Thus, as the residual toner passes through the charging station a, the reversely charged toner particles and the insufficiently charged toner particles are adhered to the charge roller 2, contaminating the charge roller 2 beyond the tolerable range, in other words, making it impossible for the charge roller 2 to satisfactorily charge the photoconductive drum 1.

Further, in order to effectively remove the residual toner particles on the peripheral surface of the photoconductive drum 1 by the developing apparatus 4 at the same time as the developing process is carried out by the developing apparatus 4, it is necessary that the residual toner particles on the photoconductive drum 1, which are being conveyed to the development station c, are normal in polarity, and also that the amount of the electrical charge, which they hold, is proper for an electrostatic latent image on the photoconductive drum 1 to be satisfactorily developed by the developing apparatus. The reversely charged toner particles and the toner particles with an unsatisfactory amount of electrical charge cannot be removed (recovered) from the photoconductive drum 1 by the developing apparatus 4, becoming the sourges of image defects.

Thus, the image forming apparatus in this embodiment is provided with a residual toner particle (transfer residual developer image) uniformizing means 8 (first developer charging member) and a toner (developer) charge amount controlling means 7 (second developer charging member) for making all the residual toner particles charged to the negative polarity, or the normal polarity. In terms of the rotational direction or the photoconductive drum 1, the residual toner particle uniformizing means 8 is positioned on the immediate downstream side of the transfer station d, whereas the second developer charging member 7 is positioned on the downstream side of the residual toner particles uniformizing means 8 and on the upstream side of the charging station a.

Generally, the toner particle which was not transferred onto the transfer medium p from the photoconductive drum 1 in the transfer station d, that is, the residual toner on the photoconductive drum 1, is the mixture of reversely charged toner particles and the toner particles with an improper amount of electrical charge. Thus, the toner particles in the residual toner are once cleared of electrical charge by the residual toner (residual developer image) uniformizing means 8, and then, are charged to their normal polarity by the toner charge amount controlling means 7. As a result, it is ensured that the residual toner does not adhere to the charge roller 2 and also that is completely removed and recovered from the photoconductive drum 1 by the developing apparatus 4, being thereby prevented from generating the ghosts reflecting the pattern in which the residual toner remained adhered to the peripheral surface of the photoconductive drum 1.

In this embodiment, the above described residual toner particle uniformizing means 8 and toner charge amount controlling means 7 are fibrous brushes, as electrodes, with a proper degree of electrical conductivity. They are positioned so that their actual brush portions remain in contact with the peripheral surface of the photoconductive drum 1

A reference numeral f stands for the contact area between the residual toner particle uniformizing means 8 and the peripheral surface of the photoconductive drum 1, and a reference numeral e stands for the contact area between the toner charge amount controlling means 7 and the peripheral surface of the photoconductive drum 1.

To the residual toner particle uniformizing means 8, positive DC voltage is applied from an electrical power surge S5, and to the toner charge amount controlling means 7, negative DC voltage is applied from an electrical power source S4. More specifically, in the environment which is 23° C. in temperature, and 10.5 g/m$^3$ in absolute humidity, DC voltages of +400 V and −800 V are applied to the residual toner particle uniformizing means 8 and toner charge amount controlling means 7, respectively.

The residual toner particles, or the toner particles which remained on the photoconductive drum J in the transfer station d after the transfer of the toner image onto the transfer medium p, reach the contact area f between the residual toner particle uniformizing means 8 and photoconductive drum 1, in which they are uniformly distributed across the peripheral surface of the photoconductive member while being uniformized in the amount of electrical charge, at about 0 $\mu$C/g. After being uniformized in the distribution and amount of electrical charge, the residual toner particles reach the contact area e between the toner charge amount controlling means 7 and photoconductive drum 1, in which all the residual toner particles are charged to their normal polarity, that is, the negative polarity, by the toner charge amount controlling means 7.

With all of the residual toner particles charged to the negative polarity, or the normal polarity, the mirror force of the residual toner particles in relation to the photoconductive drum 1 is greater. Therefore, when the peripheral surface of the photoconductive drum 1 is charged in the contact area a, or the charging station, between the charge roller 2 and photoconductive drum 1, with the presence of the residual toner particles on the peripheral surface of the photoconductive drum 1, the residual toner particles are prevented from adhering to the charge roller 2. The amount of the electric charge given to the residual toner particles, for this purpose, by the toner charge amount controlling means 7 needs to be approximately twice or more, compared to the proper amount of the electrical charge which the toner particles hold for developing an electrostatic latent image. In the environment which is 23° C. in temperature, and 10.5 g/m$^3$ in absolute humidity, it is −70 $\mu$C/g. Further, even if a small amount of toner particles adheres to the charge roller 2, the toner particles are charged to their normal polarity by the friction between them and cleaning film 2*f*, being therefore returned from the charge roller 2 onto the photo conductive drum 1.

Next, the recovery of the residual toner during the developing process will be described. As described above, the developing apparatus 4 is of a cleaner-less type which removes the residual toner by the developing apparatus 4 at the same time as the developing process is carried out by the developing apparatus 4. In the environment which is 23° C in temperature, and 10.5 g/m$^3$ in absolute humidity, the amount of the electrical charge, which the toner particles hold after being transferred onto the peripheral surface of the photoconductive drum 1 from the charge roller 2, is −25 $\mu$C/g Here, the relationship between the recovery of the residual toner particles and the amount of the electrical charge given to the transfer residual toner particles to recover them by the developing apparatus 4, under the development conditions in this embodiment, is shown in Table 1.

TABLE 1

| Charge Amount | Collection property |
|---|---|
| −10.0 | NG |
| −12.5 | G |
| −15.0 | G |
| −30.0 | G |
| −40.0 | G |
| −45.0 | G |
| −50.0 | NG |

In comparison to the amount (−25 $\mu$C/g) of the electrical charge given to the toner to develop an electrostatic latent image, the amount of the electrical charge given to the residual toner particles on the photoconductive drum 1 to recover them by the developing apparatus 4 needs to be 0.5–1.8 times. However, in consideration of the fact that the residual toner particles must be prevented from adhering to the charge roller 2, it is desired that the residual toner is given a greater amount of negative electrical charge, that is, −70 $\mu$C/g, by the toner charge amount controlling means 7. In order to recover the residual toner with a large amount of negative electrical charge by the developing apparatus 4, it is desired that the residual toner particles are electrically discharged by the charge roller 2, Here, the relationship between the amount of the electrical charge, which the toner particles on the photoconductive drum 1, which had given an electrical charge of −70 $\mu$C/g, had after it had passed by the charge roller 2, and the peak-to-peak voltage Vpp of the AC voltage applied to the charge roller 2, is shown Table 2. It is evident from Table 2 that the greater the peak-to-peak voltage Vpp of the AC voltage, the greater the amount by which electrical charge is removed from the residual toner particles on the photoconductive drum 1.

TABLE 2

| Applied AC Volt. | Charge Amount ($\mu$C/g) |
|---|---|
| 1000 | −68.0 |
| 1200 | −45.0 |
| 1400 | −35.0 |
| 1600 | −24.0 |
| 1800 | −12.0 |
| 2000 | −7.0 |

In order to charge the peripheral surface of the photoconductive drum 1, an AC voltage (1 kHz in frequency; 1.5 kV in peak-to-peak voltage Vpp) was applied to the charge roller 2. Thus, the electrical charge of the residual toner particles was removed by the function of the AC voltage; the amount of the electrical charge of the residual toner particles was reduced to −30 $\mu$C/g as the residual toner particles went through the charging station a. During the developing process, the residual toner particles on the areas of the photoconductive drum 1 which were nut to be developed by toner, were recovered by the developing apparatus 4 because of the above described reason.

In other words, while the residual toner particles on the photoconductive drum 1 were conveyed from the transfer station d to the charging station b, they were rectified in polarity by the toner charge amount controlling means 7 so that all the residual toner particles became normal, that is, negative, in polarity, being thereby prevented from adhering to the charge roller 2. Then, in the charging station b, at the same time as the peripheral surface 1 was charged by the charge roller.

However, the amount of the electrical charge which toner holds is substantially affected by the environment in which an image forming apparatus is used Therefore, in order to control the amount of the electrical charge which the residual toner particles acquire in the above described cleaner-less system, it is necessary to take into consideration the environment in which an image forming apparatus is used, in particular, the absolute humidity of the environment. Thus, in this embodiment, the image forming apparatus was provided with a temperature/humidity sensor 9 for detecting the temperature and relative humidity within the image forming apparatus. The sensor 9 was disposed within the image forming apparatus and inputted the information regarding the internal temperature and relative humidity or the image forming apparatus into a control circuit 10. The control circuit 10 calculated the absolute humidity of the environment in which the image forming apparatus was used, from the inputted temperature and relative humidity, and adjusted, according to the condition (absolute humidity) of the environment in which the image forming apparatus was used, the DC voltages applied to the residual toner particle uniformizing 8 and toner charge amount controlling means 7.

[Calculation of Absolute Humidity]

The absolute humidity x is obtained from the following equation:

$$x=0.622\times T\times ps/(p-T\times ps)\ (\text{kg/kg}') \quad (1)$$

T: relative humidity t: dry environment temperature (° C).

Further, the relative humidity T (which is assumed to stabilize at 760 mmHg) is obtained from the following equation based on the water vapor partial pressure:

$$T=p/ps(\%) \quad (2)$$

P: water vapor partial pressure (mmHg) in humid air ps: water vapor partial pressure (mmHg) of humidity saturated air.

P: total pressure of the humid air (constant at 760 mmHg)

Next, the relationship between the DC voltage applied to the residual toner particle uniformizing means 8 and the absolute humidity will be described.

When the absolute humidity is no less than 18.0 g/m$^3$, the amount of the electrical charge of the residual toner particles immediately after the residual toner particles have passed the transfer station d is approximately 0 $\mu$C/g. Thus, if the potential level of the DC voltage applied to the residual toner particles uniformizing means 8 is +350, the residual toner particles is sometimes made positive in polarity (reverses in polarity) by the residual toner particle uniformizing means 8, and therefore, cannot be satisfactorily recovered by the developing apparatus 4 in the following image forming process, which is a problem.

On the other hand, when the absolute humidity is no more than 5.8 g/m$^3$, the amount of the electrical charge of some of the residual toner particles becomes approximately 0 $\mu$C/g, and that of the others becomes 50 $\mu$C/g, as the residual toner particles pass the transfer station d. Thus, if the potential level of the DC voltage applied to the residual toner particle uniformizing means 8 is +350, the amount of the electrical charge of the residual toner particles sometimes cannot be reduced to approximately 0 $\mu$C/g by the residual toner particle uniformizing means 8, and therefore 7 the residual toner particles cannot be satisfactorily recovered by the developing apparatus 4 in the following image formation process, which is a problem.

Thus, in this embodiment, the control circuit 10 of the image forming apparatus was provided with referential data such as those shown in FIG. 1. The control circuit 10 calculated the absolute humidity of the environment in which the image forming apparatus was used, from the temperature and relative humidity inputted from the temperature/humidity sensor 8, and adjusted, according to the calculated absolute humidity of the environment in which the image forming apparatus was used and the referential data, the DC voltage applied to the residual toner uniformizing 8. With the provision of this arrangement, the above described effect of the transfer residual toner particle uniformizing means 8 upon the residual toner particles remained stable regardless of the environment in which the image forming apparatus was used.

Next, the relationship between the DC Voltage applied to the toner charge amount controlling means 7 and the absolute humidity will be described.

When the potential level of the DC voltage applied to the toner charge amount controlling means 7 in the environment in which the absolute humidity was no less than 18.0 g/m$^3$ was −800 V, the amount of the electrical charge of the residual toner particles sometimes unnecessarily increased in the contact area e between the toner charge amount controlling means 7 and photoconductive drum 1, making it impossible for the residual toner particles to be satisfactorily recovered by the developing apparatus 4 in the following image forming process, which was a problem.

On the other hand, when the potential level of the DC voltage applied to the toner charge amount controlling means 7 in the environment in which the absolute humidity was no more than 5.8 g/m$^3$ was −800 V, the amount of the electrical charge of the residual toner particles sometimes could not be reduced to a desired value in the contact area e between the toner charge amount controlling means 7 and photoconductive drum 1. As a result, the residual toner particles adhered to the surface of the contact charge roller 4, or the like problems occur.

Figure 4:
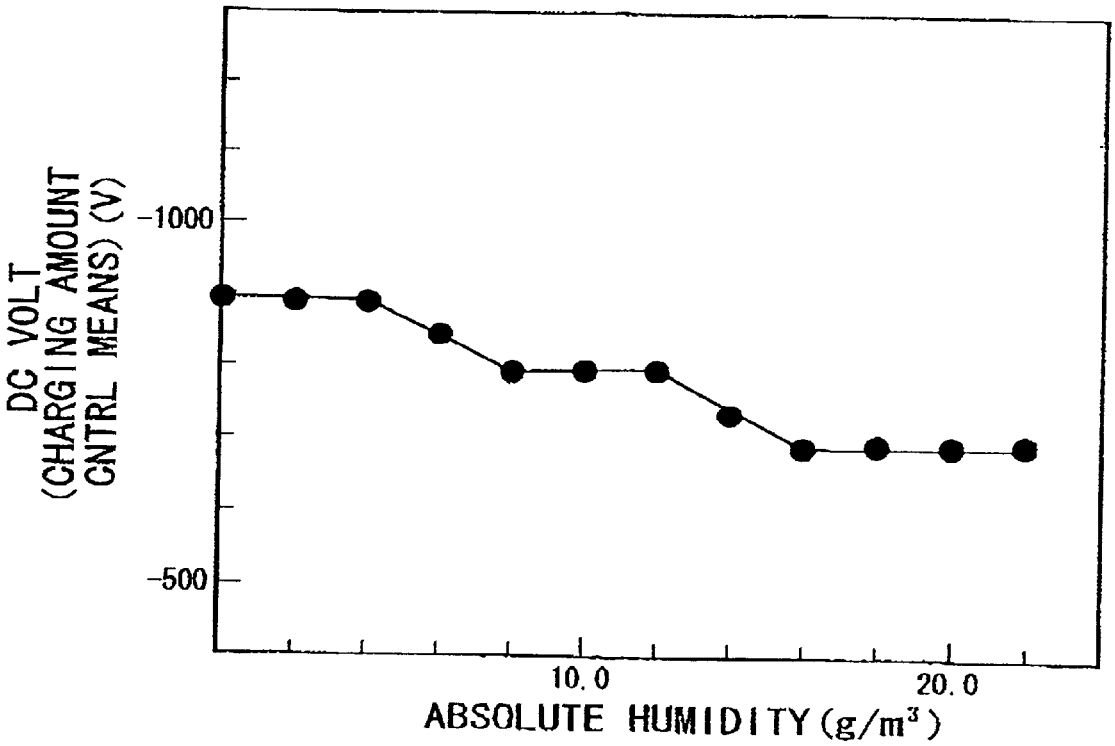
FIG. 4 is a graph for showing the relationship between the absolute humidity in the environment in which the image forming apparatus is used, and the DC voltage applied to the toner charge amount controlling means.

Thus, in this embodiment, the control circuit 10 of the image forming apparatus was provided with referential data such as those shown in FIG. 4. The control circuit 10 calculated the absolute humidity of the environment in which the image forming apparatus was used, from the temperature and relative humidity inputted from the temperature/humidity sensor 9, and adjusted, according to the calculated absolute humidity of the environment in which the image forming apparatus was used, and the referential data, the DC voltage applied to the toner charge amount controlling means 7. With the provision of this arrangement, the above described effect of the toner charge amount controlling means 7 upon the residual toner particles remained stable regardless of the environment in which the image forming apparatus was used.

As was demonstrated by the above described embodiment of the present invention, according to the present invention, the DC voltages applied to the toner charge amount controlling means 7 and residual toner particle uniformizing means 8 are adjusted according to the absolute humidity of the environment in which an image forming apparatus is used. Therefore it is possible to provide an image forming apparatus in which the unsatisfactory charging of the image bearing member and/or the formation of a defective image do not occur, in spite of its employment of a cleaner-less system, regardless of the conditions of the environment in which the image forming apparatus is used.

Further, if necessary, it is possible to structure an image forming apparatus so that the DC voltage adjusted according to the absolute humidity of the conditions of the environment in which an image forming apparatus is used, is limited to either the DC voltage applied to the toner charge amount controlling means 7 or the DC voltage applied to the residual toner particle uniformizing means 8.

(Embodiment 2)

The basic structure of the image forming apparatus (printer) in this embodiment is the same as that in the first embodiment.

As is evident from the description of the first embodiment, by controlling the amount of the electrical charge of the transfer residual toner particles, with the application of proper DC voltages to the toner charge amount controlling means 7 and/or residual toner particle uniformizing means 8, the residual toner particles, that is, the toner particles remaining on the portion of the photoconductive drum 1 which has just passed the transfer station d, can be efficiently recovered by the developing apparatus 4, at the same time as the developing process is carried out by the developing apparatus 4.

However, the amount of the electrical charge, which the transfer residual toner particles on the photoconductive drum 1 hold immediately after they have passed the transfer station d, is affected by the printing ratio. Therefore, the amount of the electrical charge given to the residual toner particles by the toner charge amount controlling means 7 and/or residual toner particle uniformizing means 8 (primarily, residual toner particle uniformizing means 8) in order to clean the photoconductive drum 1 with the use of the developing apparatus 4 at the same time as the developing process is carried out by the developing apparatus 4, should be adjusted according to the printing ratio.

Figure 5:
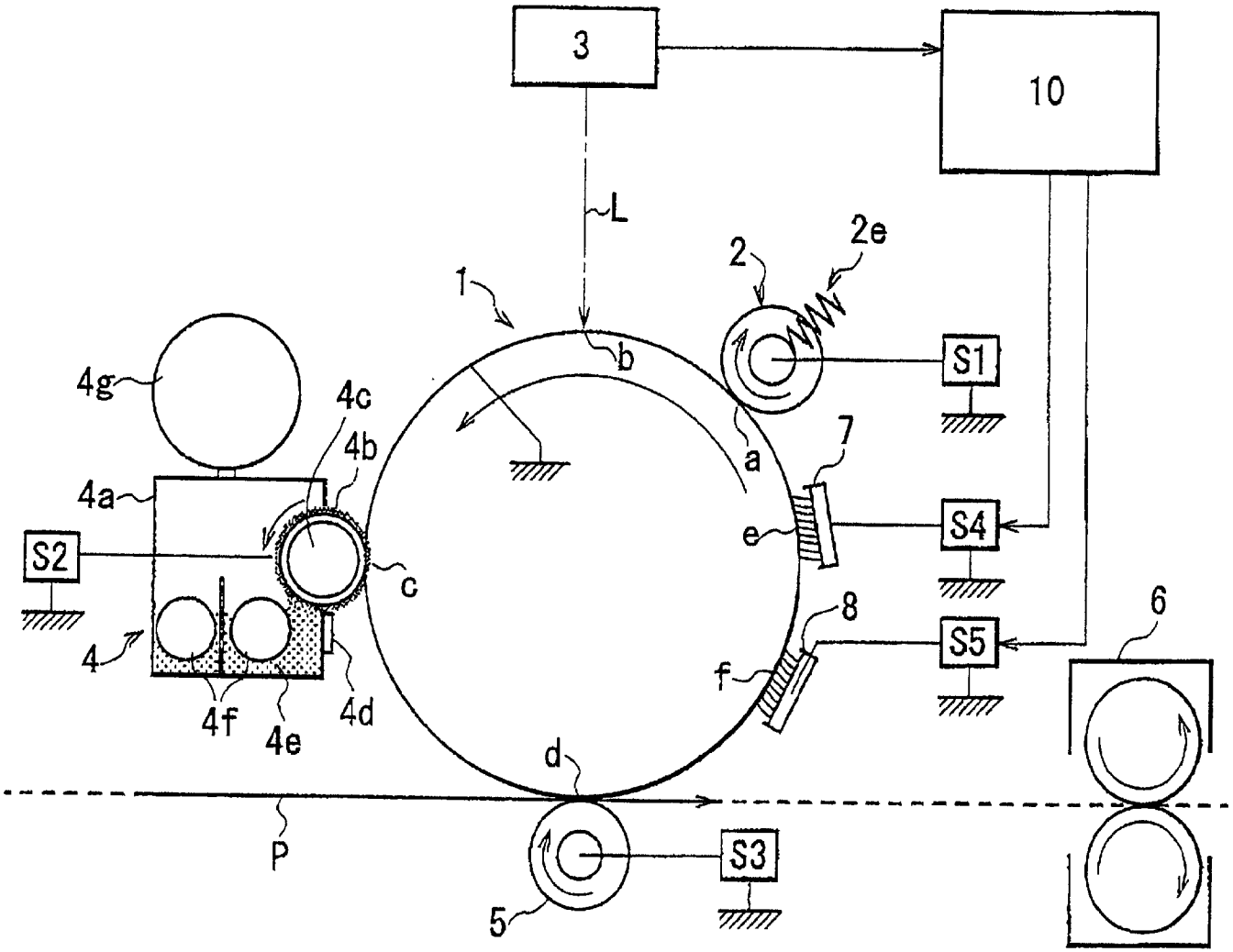
FIG. 5 is a schematic drawing of the image forming apparatus in the second embodiment of the present invention, for showing the general structure thereof.

Thus, in this embodiment, the information regarding the printing ratio was detected by the exposing means 3 as an image writing means, as shown in FIG. 5, and this information was inputted into the control circuit 10. The control circuit 10 adjusted the DC voltages applied to the toner charge amount controlling means 7 and residual toner particle uniformizing means 8 according to the inputted information regarding the printing ratio.

Hereinafter, this embodiment will be described in detail.

Figure 6:
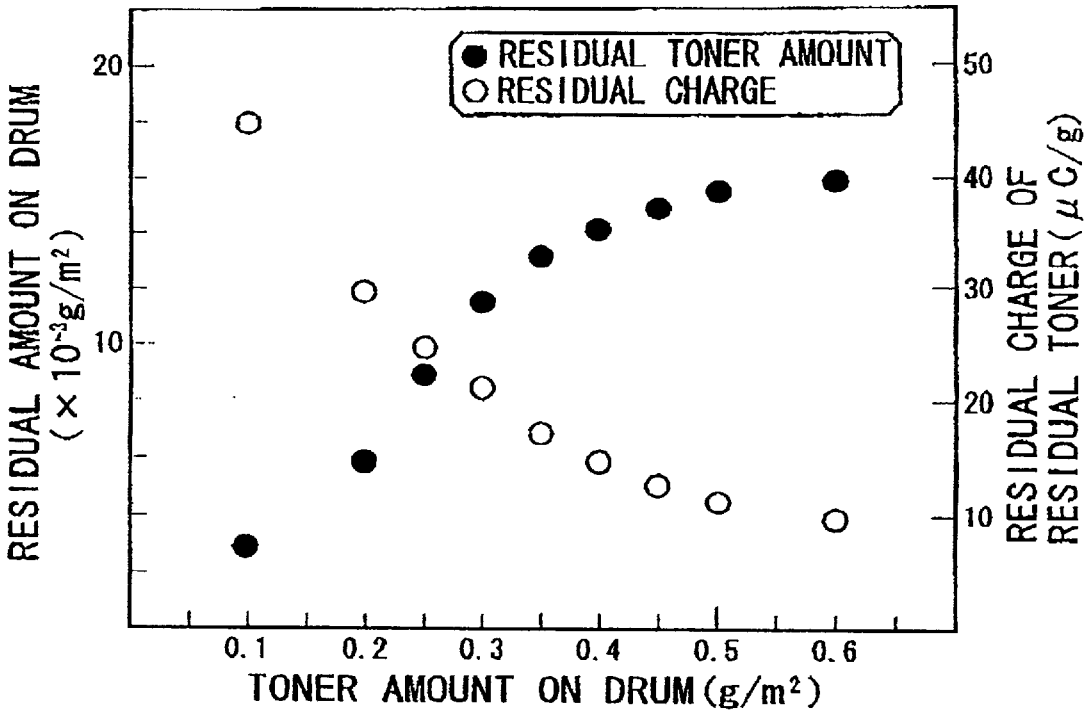
FIG. 6 is a graph for showing the relationship among the total amount of the toner adhered to the photoconductive drum by development (printing ratio), the amount of the residual toner on the photoconductive drum, and the amount of electrical charge given to the residual toner on the photoconductive drum.

FIG. 6 shows the relationship among the printing ratio, that is, the amount or the toner particles which are on the photoconductive drum 1 immediately after the development process was carried out by the developing apparatus 4, the amount of the residual toner particles which are on the portion of the photoconductive drum 1 which has just passed the transfer station d, the amount of the electrical charge which the toner particles, which are on the photoconductive drum 1 immediately after the development process, hold, and the amount of the electrical charge which the residual toner particles on the portion of the photoconductive drum 1, which has just passed the transfer station d, hold. It is evident from this graph that the greater the printing ratio, the greater the amount of the residual toner particles, but the smaller the amount of the electrical charge the residual toner particles hold. More specifically, when the printing ratio was small, that is, 0.1 $g/m^2$, the amount of the residual toner particles was $3\times10^{-2}$ $g/m^2$ and the amount of the electrical charge or the residual toner particles was 45 $\mu$C/g, whereas when the printing ratio was large, that is, 0.6 $g/m^2$, the amount of the residual toner particles was $6\times10^{-2}$ and the amount of the electrical charge of the residual toner particles was 10 $\mu$C/g.

Figure 7:
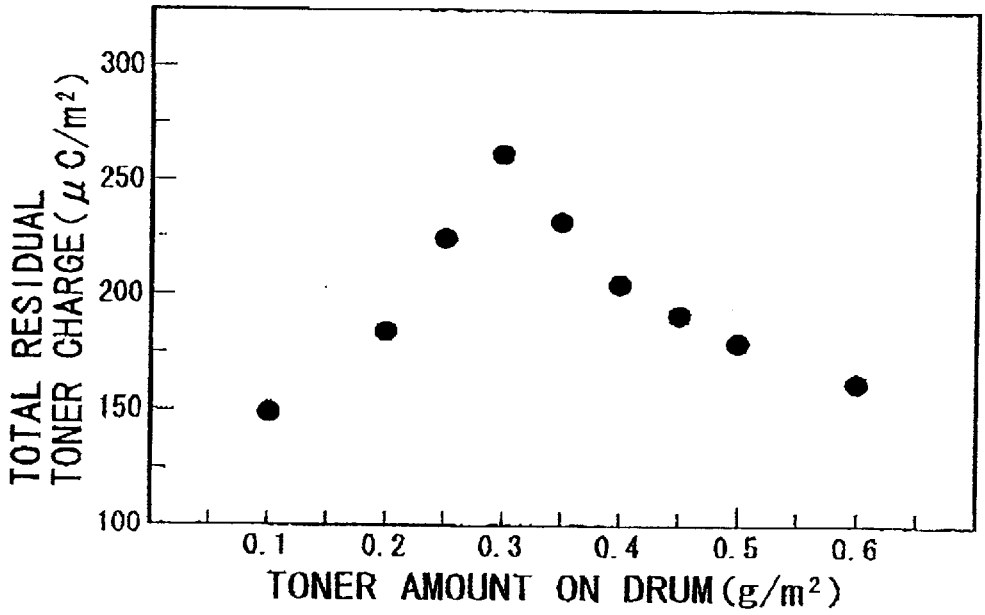
FIG. 7 is a graph for showing the relationship among the total amount of the toner adhered to the photoconductive drum by development (printing ratio), and the overall amount of the electrical charge given to the residual toner on the photoconductive drum.

It is also evident from this graph that when the printing ratio was 0.1 $g/m^2$, the amount of the electrical charge of the residual toner particles was approximately 45 $\mu$C/g, whereas when the printing ratio was 0.6 $g/m^2$, it was approximately 10 $\mu$C/g. In consideration of the fact that the total amount of the electrical charge which the residual toner holds per unit area is the product of the amount of the electrical charge of each residual toner particle and the amount of the transfer residual toner particles, it is evident that the total amount of the electrical charge which the residual toner holds when the printing ratio was 0.1 $g/m^2$ was approximately the same as that when the printing ratio was 0.6 $g/m^2$ FIG. 7 shows the relationship between the printing ratio, that is, the amount of the toner on the portion of the photoconductive drum 1 which has just passed the developing apparatus 4, and the total amount of the electrical charge of the residual toner per unit area. It is evident from this graph that the total amount of the electrical charge which the residual toner held when the printing ratio was 0.1 $g/m^2$ was approximately the same as that when the printing ratio was 0.6 $g/m^2$, but the total amount of the electrical charge the residual toner held was affected by the printing ratio, being the largest when the printing ratio was 0.3 $g/m^2$. This means that in order to adjust the amount of the electrical charge of the residual toner particles to a desired amount with the use or toner charge amount controlling means 7 and residual toner particle uniformizing means 8, the DC voltages applied to the toner charge amount controlling means 7 and residual toner particle uniformizing means 8 should be adjusted according to the printing ratio.

Figure 8:
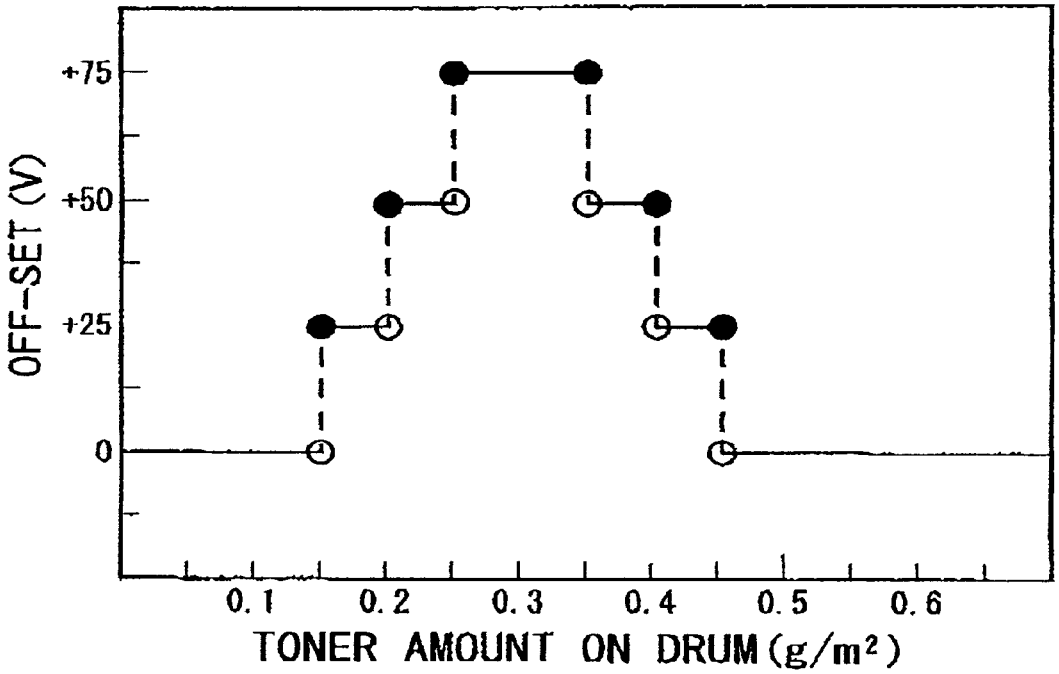
FIG. 8 is a graph for showing the relationship between the total amount of the toner adhered to the photoconductive drum by development (printing ratio), and the amount by which the DC voltage applied to the residual toner uniformizing means is adjusted.

Thus, in this embodiment, the control circuit 10 was provided with referential data such as those shown in FIG. 8, and the DC voltage applied to the residual toner particle uniformizing means 8 was adjusted by the control circuit 10, by the amount shown in FIG. 8, based on the DC voltages applied to the residual, toner particle uniformizing means 8 when the printing ratios were 0.1 $g/m^2$ and 0.6 $g/m^2$, and also, according to the information regarding the printing ratio inputted into the control circuit 10 from the exposing means 3 and the referential data.

As described above, according to this embodiment of the present invention, the information regarding the printing ratio is detected by the exposing means 3 as an image writing means, and the DC voltages applied to the toner charge amount controlling means 7 and transfer residual toner particle uniformizing means 8 (primarily, transfer residual toner particle uniformizing means 8) are adjusted according to the printing ratio. Therefore, it is possible to provide a cleaner-less image forming apparatus in which the unsatisfactory charging of the image bearing member and the formation of a defective image do not occur regardless of the printing ratio.

If necessary, it is possible to structure an image forming apparatus so that the DC voltage adjusted according to the printing ratio is limited to either the DC voltage applied to the toner charge amount controlling means 7 or the DC voltage applied to the residual toner particle uniformizing means 8, in particular, the residual toner particle uniformizing means 8.

(Embodiment 3)

Figure 9:
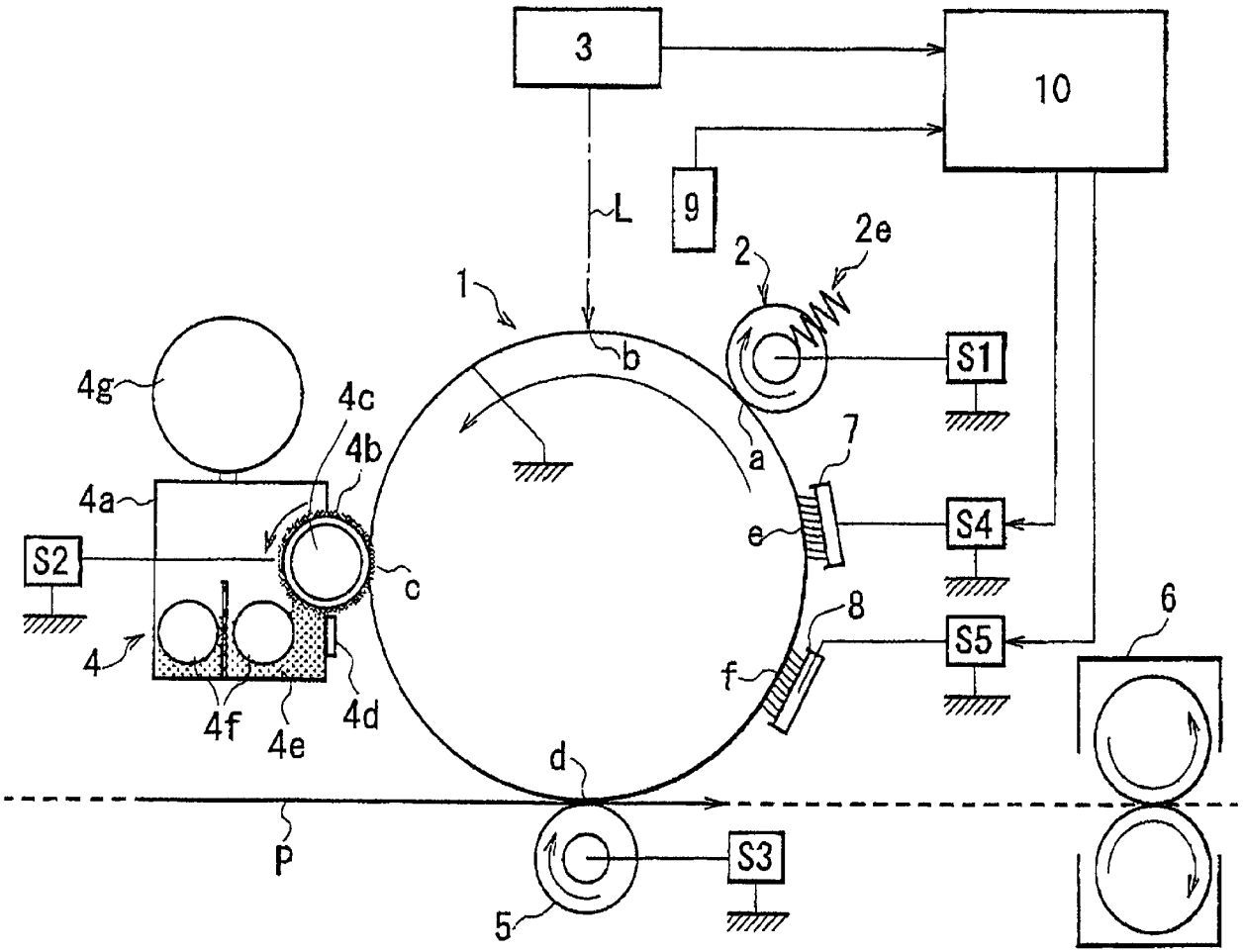
FIG. 9 is a schematic drawing of the image forming apparatus in the third embodiment of the present invention, for showing the general structure thereof.

This embodiment is the combination of the first and second embodiments. More specifically, referring to FIG. 9, the image forming apparatus is provided with the temperature/humidity sensor 9, which is disposed within the image forming apparatus, and the DC voltages applied to the toner charge amount controlling means 7 and residual toner particle uniformizing means 8 (primarily, residual toner particle uniformizing means 8) are adjusted according to the absolute humidity of the environment in which the image forming apparatus is used, calculated from the temperature and humidity detected by the temperature/humidity sensor 9, and also, according to the information regarding the printing ratio obtained from the amount of the exposure by the exposing means 3 as an information writing means.

With the provision of the arrangement, it is possible to provide a cleaner-less image forming apparatus in which the unsatisfactory charging of the image bearing member and the formation of a defective image do not occur.

If necessary, it is possible to structure an image forming apparatus so that the DC voltage adjusted according to the absolute humidity of the environment in which the image forming apparatus is used, calculated from the temperature and humidity detected by the temperature/humidity sensor 9 disposed within the image forming apparatus, and the information regarding the printing ratio obtained from the amount of the exposure by the exposing means 3 as an information writing means, is limited to either the DC voltage applied to the toner charge amount controlling means 7 or the DC voltage applied to the residual toner particle uniformizing means 8, in particular, the DC voltage applied to the residual toner particle uniformizing means 8.

(Embodiment 4)

In this embodiment, the voltages applied to the developer charging members 7 and 8 are controlled according to the zone of the environmental factor detected by an environment sensor. The image bearing member, charging means, information writing means, developing means, transferring means, and fixing means in this embodiment are the same in structure and operation as those in the first embodiment shown in FIG. 1. Therefore, they will not be described here.

Also in this embodiment, the main assembly of the image forming apparatus is provided with an environment sensor 9 as was in the first embodiment. The specific zone of the factors (temperature and humidity) of the environment in which the main assembly of the image forming apparatus is being used is determined based on the temperature and humidity measured by the environment sensor 9. To describe in more detail, the range of the environmental factor, which in this embodiment is the absolute humidity, is divided into seven zones (Table 3), and to which zone the environment in which the main assembly of the image forming apparatus is being used belongs is determined based on the absolute humidity calculated from the temperature and humidity measured by the environment sensor 9. With the division of the range or the humidity of the environment in which the image forming apparatus is used, into a certain number of zones, it is possible to reduce the capacity of the memory in which the relationship between the changes in the environmental conditions, and the value to which the voltages applied to the toner charge amount controlling means 7 and residual toner particle uniformizing means 8 are adjusted, is stored, compared to the first embodiment.

TABLE 3

Absolute Humidity and Environmental Zones

| Zone Nos. | humidity zone |
|---|---|
| 1 | <1.4 (L/L) |
| 2 | 1.4–5.8 |
| 3 | 5.8–10.5 |
| 4 | 10.5–15.0 |
| 5 | 15.0–18.0 |
| 6 | 18.0–21.6 |
| 7 | ≧21.6 (H/H) |

Next, the cleaner-less system and toner charge amount control, in this embodiment, will be described.

The printer in this embodiment is of a cleaner-less type. In other words, it is not equipped with a cleaning apparatus dedicated to the removal of the residual toner particles, that is, a small amount of toner particles remaining on the peripheral surface of the photoconductive drum 1 after the transfer of the toner image onto the transfer medium p. Thus, after the transfer, the residual toner particles on the peripheral surface of the photoconductive drum 1 are conveyed farther by the continual rotation of the photoconductive drum 1, through the charging station a and exposing station b, and to the development station C, in which they are removed (recovered) by the developing apparatus 4 at the same time as the development process is carried out by the developing apparatus (cleaner-less system).

Since the residual toner particles on the peripheral surface of the photoconductive drum 1 go through the exposing station b, the exposing process is carried out with the presence of the residual toner particles on the peripheral surface. However, the is amount of the residual toner particles is very small, and therefore, the presence of the residual toner particles does not greatly affect the exposing process, except for the following.

That is, as described before, in terms of polarity, the residual toner is the mixture of the normally charged (negatively charged) toner particles and reversely charged (positively charged) toner particles (reversal toner particles). Further, some of the toner particles have an insufficient amount of electrical charge. Thus, as the residual toner passes through the charging station a, the reversal toner particles and the insufficiently charged toner particles adhere to the charge roller 2, contaminating the charge roller 2 beyond the tolerable range, in other words, making it impossible for the charge roller 2 to satisfactorily charge the photoconductive drum 1.

Further, in order to efficiently remove the residual toner particles on the peripheral surface of the photoconductive drum 1 by the developing apparatus 4 at the same time as the developing process is carried out by the developing apparatus 4, it is necessary that the residual toner particles on the photoconductive drum 1, which are being conveyed to the development station c, are normal in polarity, and also that the amount of the electrical charge, which they hold, is the proper amount for an electrostatic latent image on the photoconductive drum 1 to be satisfactorily developed by the developing apparatus 4.

The reversal toner particles and the toner particles with an unsatisfactory amount of electrical charge cannot be removed (recovered) from the photoconductive drum 1 by the developing apparatus 4, becoming the sourges of image defects.

Further, in recent years, the user needs have become multifarious, making it likely for images with a high printing ratio, such as photographic images, to be continually printed. As images with a high printing ratio are continually printed, a large amount of the residual toner is generated all at once, exacerbating the above described problems.

Thus, in order to uniformly redistribute the residual toner particles across the photoconductive drum 1, and assure that all the residual toner particles become charged to the negative polarity, that is, the normal polarity, the image forming apparatus is provided with the first and second developer charging members 8 and 7, which are disposed on the downstream side of the transfer station d in terms of the rotational direction of the photoconductive drum 1, and the upstream side of the charging station a.

In this embodiment, the first and second developer charging members 8 and 7 are fibrous brushes with a proper degree of electrical conductivity. They are positioned so that their actual brush portions remain in contact with the peripheral surface of the photoconductive drum 1.

To the first developer charging member 8, positive voltage (positive bias) is applied from an electrical power sourge S5.

A reference numeral f stands for the contact area between the first developer charging member 8 and the peripheral surface of the photoconductive drum 1. Among the residual toner particles on the photoconductive drum 1, which are different in polarity, the particles with virtually no electrical charge and the negatively charged particles are absorbed by the first developer charging member 8. However, the amount of the toner which the first developer charging member 8 can hold is limited. Thus, as the residual toner particles saturate the first developer charging member 8, they gradually escape from the first developer charging member 8, adhere to the peripheral surface of the photoconductive drum 1, and are conveyed. At this point in an image forming operation, the residual toner particles are positive in polarity, and also, through the above described process, the residual toner particles have been evenly distributed on the photoconductive drum 1, being prevented from being carried downstream all at once by a large amount. Further, the first developer charging member 8 plays the role of reducing the potential level of the residual toner particles on the photoconductive drum 1 to virtually zero volt, providing difference in potential level between the residual toner particles on the photoconductive drum 1 and the voltage applied to the second developer member 7, which will be described later, so that the residual toner particles are given a sufficient amount of proper electrical charge.

To the second developer charging member 7, negative voltage is applied from the electrical power sourge S5 S4. A reference numeral e stands for the contact area between the second developer charging member 7 and the peripheral surface of the photoconductive drum 1.

While the residual toner particles on the photoconductive drum 1 pass the second developer charging member 7, all of them are made negative, that is, normal, in polarity. Since all of the residual toner particles have been made positive in polarity, and the potential level on the photoconductive drum 1 has reduced to virtually zero volt, by the first developer charging member 8, all of the residual toner particles are more efficiently turned negative in polarity by the second developer charging member 7. Since all of the residual toner particles are made negative, that is, normal, by the second developer charger member 7, the mirror force of the residual toner particles relative to the photoconductive drum 1 is greater when the peripheral surface of the photoconductive drum 1 is charged with the presence of the residual toner particles on the peripheral surface of the photoconductive drum 1, in the charging station a, which is located further downstream. Therefore, the residual toner particles are prevented from adhering to the charge roller 2; in other words, they go through the charging station a without adhering to the charge roller 2. After passing by the charge roller 2, they are recovered by the developing device at the same time as the developing process is carried out by the developing device.

At this time, the developing/cleaning process, that is, the process in which the residual toner particles are removed from the peripheral surface of the image bearing member, in the charging station, at the same time as the developing process is carried out by the developing apparatus, will be described.

The developing/cleaning process is a process in which the transfer residual toner particles on the photoconductive member are recovered by the developing apparatus, using the fog prevention bias. More specifically, after the transfer of a toner image on the photoconductive member, the portion of the photoconductive member, from which the toner image has been transferred, is charged with the presence of the residual toner on the photoconductive member, and an electrostatic latent image is formed thereon by exposure, also with the presence of the residual toner particles. Then, while this electrostatic latent image is developed by the developing apparatus, those residual toner particles, which are on the areas (non-image areas) of the peripheral surface of the photoconductive member, which are not to be developed by toner, are removed (recovered) by the developing apparatus, using the fog prevention bias (difference Vback in potential level between DC voltage applied to developing apparatus and potential level of peripheral surface of photoconductive member).

In order to recover the residual toner particles on the photoconductive drum 1 into the developing apparatus 4 with the use of the process described above, the residual toner particles must have a proper amount of electrical charge.

However, for the purpose of preventing the residual toner particles from adhering to the charge roller 2 as described above, the greater the amount of the negative electrical charge given to the residual toner particles, the better. On the other hand, for the purpose of recovering the residual toner particles with a large amount of negative charge by the developing apparatus 4, the residual toner particles should be cleared of electrical charge by the charge roller 2.

After being given a large amount of negative charge by the second developer charging member 7, the electrical charges of the residual toner particles are removed by the AC voltage (1,000 Hz in frequency f; 1.400 V in peak-to-peak voltage Vpp) applied to the charge roller 2. Thus, after going through the charging station a, the amount of the electrical charge which the residual toner particles hold is approximately the same as the electrical charge which the toner particles for development hold. Therefore, in the developing process, the transfer residual toner particles on the areas of the photoconductive drum 1 to which toner particles are not to be adhered, are recovered by the developing apparatus 4, for the reason given above.

Next, the characteristic aspect of this embodiment, that is, the method for controlling the voltage applied to the developer charging members, according to the environmental conditions, will be described in detail.

In order to determine the proper value for the voltage applied to the first developer charging member in the various environments, the inventors of the present invention printed 30,000 A4 size copies, using different voltages as the voltage applied to the first developer charging member 7, and evaluated the copies. The voltage applied to the second developer charging means 8 during this operation was fixed at −800 V.

The results of the evaluation are given in Table 4.

TABLE 4

| | | Voltage applied to First Charging Member and Image Defects | | | | | | |
|---|---|---|---|---|---|---|---|---|
| | | Applied Voltage (V) | | | | | | |
| | | 200 | 250 | 300 | 350 | 400 | 450 | 500 |
| H/H | Roller Contamination | N | F | G | G | G | G | G |
| 30° C. | Untransfer Ghost | N | G | G | G | G | G | G |
| 80% RH | Negative Ghost | G | G | G | N | N | N | N |
| L/L | Roller Contamination | N | N | N | F | G | G | G |
| 15° C. | Untransfer Ghost | N | N | F | G | G | G | G |
| 10% RH | Negative Ghost | G | G | G | G | G | N | N |

G: good
F: image defect may occur.
N: image defect occurs.

In the H/H environment, the charge roller contamination occurred when the voltage applied to the second developer charging member was no more than 250 V, and in the L/L environment, it occurred when the voltage applied to the second developer charging member was no more than 350 V. It is conceivable that this charge roller contamination occurred due to the following reason, that is, when the voltage applied to the first developer charging member was lower than a certain level, the difference in potential level between the first developer charging member and photoconductive member was insufficient for the first developer charging member to be enabled to temporarily retain the residual toner particles and expel them back onto the peripheral surface or the photoconductive member evenly across the peripheral surface, at a satisfactory level. Therefore, a large amount of the residual toner particles entered the second developer charging member.

Also, when the voltage applied to the first developer charging member was lower than a certain level, the potential level of the peripheral surface of the photoconductive member could not be sufficiently reduced to provide a sufficient amount of difference in potential level between the second developer charging member and photoconductive member. Therefore, the residual toner particles were not given a proper amount of electrical charge by the second developer charging member. In other words, all the residual toner particles were not given a sufficient amount of negative electrical charge. Thus, those residual toner particles, which did not receive a sufficient amount of negative electrical charge, adhered to the charge roller.

Further, the ghost traceable to the residual toner was also caused by the insufficient amount of difference in potential level between the first developer charging member and photoconductive member, because when the difference in potential level between the first developer charging member and photoconductive member was insufficient, the first developer charging member was not enabled to temporarily retain the residual toner particles and expel them back onto the photoconductive member evenly across the peripheral surface, at a satisfactory level, and therefore, a large amount of the residual toner particles entered the developing device all at once, making it impossible for the developing device to recover it.

These problems could be virtually eliminated by increasing the voltage applied to the first developer charging member to provide a sufficient amount of difference in potential level between the first developer charging member and photoconductive member in order to improve the charging performance of the first developer charging member.

As for the negative ghost, in the H/H environment, it occurred when the voltage applied to the first developer charging member was not less than 350 V, and in the L/L environment, it occurred when the voltage applied to the first developer charging member was not less than 450 V. It is conceivable that this negative ghost occurred for the following reason. That is, when the voltage applied to the first developer charging member increased beyond a certain level, the difference in potential level between the first developer charging member and photoconductive member became excessive; in other words, the difference in potential level became large enough to charge the surface of the photoconductive member to the polarity (positive polarity) opposite to the polarity to which it is normally charged. This problem could be solved by preventing the first developer charging member from excessively charging the residual toner particles, by reducing the voltage applied to the first developer charging member.

As is evident from the above descriptions, if the difference in potential level between the first developer charging member and photoconductive member is not proper, image defects occur. The reason for the presence of a difference of approximately 100 V in the proper voltage value between the H/H and L/L environments is that the electrical resistance value of the developer charging member is affected by the environmental conditions. A substance such as the material for the brush used as the developer charging member easily absorbs moisture, and therefore, in the high humidity environment, the first developer charging member easily absorbs moisture, declining in electrical resistance. Naturally, as the electrical resistance of the first developer charging member declines, it becomes easier for electrical current to flow through the first developer charging member, improving thereby the first developer charging member in charging performance. On the contrary, in the low humidity environment, the brush increases in electrical resistance, declining therefore in charging performance. Thus, in the H/H environment, the negative ghost is likely to occur, whereas in the L/L environment, the charge roller contamination and the ghost traceable to the residual toner are likely to occur, even if the two environmental conditions are kept the same in terms of the voltage applied to the first developer charging member.

Thus, in this embodiment, the environment, in which the main assembly of the image forming apparatus was placed, was evaluated, and the voltage applied to the first developer charging member was controlled according to the conditions of the environment in which the main assembly of the image forming apparatus was placed.

As described hereinbefore, the main assembly of the image forming apparatus in this embodiment was provided with an environment sensor. Further, the range of the environmental factor (absolute humidity in this embodiment) was divided into seven zones. Based on the information obtained by the environment sensor, it was determined to which zone of the absolute humidity the environment in which the main assembly of the image forming apparatus was disposed belonged.

In this embodiment, the voltage applied to the first developer charging member was adjusted according to the absolute humidity. Referring to Table 5, in the H/H environment (for example, 30° C., 80% RH, 216 g/cm$^3$ in absolute humidity), the electrical resistance of the first developer charging member was relatively low, and therefore, a relatively low voltage of 300 V was applied, whereas in the L/L environment (for example, 15° C.; 10% RH; 1.064 g/cm$^3$), the electrical resistance of the first developer charging member was relatively high, and therefore, a relatively high voltage of 400 V was applied. Further, the linear interpolation was used to make it possible for the voltage applied to the first developer charging member, to be controlled in response to even a minute change in the absolute humidity.

TABLE 5

| Voltage Applied to First Charging Member | | | | | | | |
|---|---|---|---|---|---|---|---|
| | Env'tal Zones | | | | | | |
| | 1 | 2 | 3 | 4 | 5 | 6 | 7 |
| Abs. humidity | ? (see Table 3) | | | | | | |
| Applied Voltages | 400 | 390 | 365 | 344 | 326 | 312 | 300 |

With the provision of the above described arrangement, the charging performance of the first developer charging member was kept constant at the proper level regardless of the changes in the environment. Therefore, the residual toner particles were given the proper amount of electrical charge, and also, the potential level of the photoconductive member was reduced to the proper level, preventing the formation of images which suffered from defects such as ghosts traceable to the charge roller contamination. In other words, it was possible to form satisfactory images regardless of the changes in the environment.

(Embodiment 5)

The structure of the image forming apparatus in this embodiment is about the same as that in the fourth embodiment. However, in order to improve the image bearing member in image quality and service life, not only is the voltage applied to the first developer charging member made controllable according to the environmental conditions, but also the voltage applied to the second developer charging member is made controllable according to the environmental conditions.

In the case of the system in the fourth embodiment, only the voltage applied to the first developer charging member was controlled according to the environmental conditions. As a result, the image defects did not occurred as long as the number of the printed copies did not exceed 30,000. In this embodiment, in order to search for the possibility of further increasing the service life of the image bearing member, 60,000 copies were printed while observing whether or not the image defects occurred.

Also in the fourth embodiment, the voltage applied to the second developer charging member was a fixed bias of −800 V. As a result, the image defects traceable to the charge roller contamination did not occur in either environmental condition. However, as the number of copies reached 60,000 in this embodiment, the image defects occurred in the L/L environment. It is conceivable that this problem occurred because the electrical resistance of the developer charging member changed due to the combination of the conductivity deterioration resulting from the increase in the cumulative apparatus usage, and the changes in the environmental conditions.

Thus, in this embodiment, the relationship between the voltage applied to the second developer charging member and the image quality was studied in relation to the environmental conditions. As for the voltage applied to the first developer charging member in this embodiment, it was the same as that in the fourth embodiment in other words, in the H/H environment, it was 300 V, whereas in the L/L environment, it was 400 V. The results of the study are shown in Table 6.

TABLE 6

| Applied Voltage to Second Charging Member and Images | | | | | | | | |
|---|---|---|---|---|---|---|---|---|
| | | −650 | −700 | −750 | −800 | −850 | −900 | −950 |
| H/H 30° C. 80% RH | Roller Contamination | N | F | G | G | G | G | G |
| | Potential Instability | G | G | G | F | F | N | N |
| L/L 15° C. 10% RH | Roller Contamination | N | N | F | G | G | G | G |
| | Potential Instability | G | G | G | G | G | F | F |

G: good
F: image defect slightly occurs.
N: image defect occurs.

In the H/H environment, the charge roller contamination occurred when the voltage applied to the second developer charging member was no more than −700 V, whereas in the L/L environment, it occurred when the voltage applied to the second developer charging member was no more than −800 V. This occurred because the difference in potential level between the second developer charging member and photoconductive member was not enough for the second developer charging member to give the residual toner particles a sufficient amount of electrical charge. As is evident from Table 6, this problem could be eliminated by improving the charging performance or the second developer charging member by increasing the voltage applied to the second developer charging member. However, when the voltage applied to the second developer charging member increased beyond a certain level, the potential level to which the second developer charging member charged the residual toner particles became unstable, which was a problem. This occurred for the following reason. That is, the increase in the voltage applied to the second developer charging member beyond a certain level made the second developer charging member excessive in charging performance, overcharging not only the residual toner particles but also the photoconductive member; in other words, the residual toner particles as well as the photoconductive member were given an excessive amount of negative electrical charge. As a result, when the residual toner particles were charged by the charge roller on the downstream side of the developer charging members, they failed to be uniformly charged; all the residual toner particles were not charged to the desired potential level. In the H/H environment, this problem occurred when the voltage applied to the second developer charging member was no less than −800 V, whereas in the l,/L environment, it occurred when the voltage applied to the second developer charging member was no less than −700 V.

As will be evident from the above explanation, the proper value for the voltage applied to the second developer charging member in the H/H environment was −750 V, whereas that in the L/L environment was −850 V. Here, the presence of the difference between the H/H and L/L environments, in terms of the proper value for the voltage applied to the second developer charging member, is due to the fact that in the H/H environment, the second developer charging member became excessive in charging performance because the second developer charging member, that is, a brush, absorbed moisture in the H/H environment and declined in electrical resistance, whereas in the L/L environment, it increased in electrical resistance, declining therefore in charging performance.

Thus, in this embodiment, the voltage applied to the second developer charging member was controlled according to the environmental condition as shown in Table 7, in the similar manner to the manner in which the voltage applied to the first developer charging member was controlled in the preceding embodiment. As a result, it became possible to reliably output satisfactory images, that is, the images which did not suffer from either of the above described two problems, until the service life of the image bearing member expired.

TABLE 7

| | Applied Voltage to First and Second Charging Member | | | | | | |
|---|---|---|---|---|---|---|---|
| | Env'tal Zones | | | | | | |
| | 1 | 2 | 3 | 4 | 5 | 6 | 7 |
| Abs. Humidity | ? (see Table 3) | | | | | | |
| First Member | 400 | 390 | 365 | 344 | 326 | 312 | 300 |
| Second Member | −850 | −840 | −820 | −800 | −780 | −760 | −750 |

In this embodiment, the range of the environmental condition in terms of the absolute humidity was divided into seven zones, and the voltages applied to the first and second developer charging members were adjusted according to only the absolute humidity, using the linear interpolation. However, the usage of the linear interpolation is not mandatory. In other words, instead of using the linear interpolation based on the seven zones, such a method that the temperature and humidity ranges are divided into a greater number of finer zones than the seven zones, and that in each zone, the voltages are kept at the levels predetermined for each zone, may be employed.

(Others)

1) In the preceding embodiments, the amount ($\mu$C/g) of the electrical charge of toner was measured using the so-called blow-off method.

2) The choice of the contact charging apparatus 2 does not need to be limited to the charging apparatus in the preceding embodiments, which employed a charge roller. In other words, the charging member which the contact charging apparatus 2 employs may be a magnetic brush, a fur brush, or the like.

3) The choice of the exposing means 3 as an information writing means does not need to be limited to the laser beam scanner in the preceding embodiments. It may be one of the digital exposing apparatuses other than the laser beam scanner. For example, it may be an LED array, a combination of a light sourge, such as a fluorescent lamp, and a liquid crystal shutter, or the like. Also, it may be an analog exposing apparatus which focally projects the image of an original onto an image bearing member.

4) The image bearing member 1 may be an electrostatically recordable dielectric member. In such a case, the surface of the dielectric member is uniformly charged to predetermined polarity and potential level, and then, an electrostatic latent image is written thereon by selectively removing the electrical charge, in the pattern reflecting the image formation information, with the use of a charge removing means (information writing means), for example, a charge removal needle array, an electron gun, etc.

5) The image receiving member may be an intermediary transfer member such as an intermediary transfer drum, an intermediary transfer belt, etc., instead of the above described transfer medium p. In such a case, a toner image is transferred twice; first, from an image bearing member onto an intermediary transfer member, and then, from the intermediary transfer member onto a transfer medium.

6) The waveform of the AC voltage of the bias applied to the contact charging apparatus 2 or developing apparatus 4 may be optional; it may be sinusoldal, rectangular, triangular, or the like. The AC bias includes voltage with such a rectangular waveform that is formed by periodically turning on and off a DC power sourge.

7) Although a stationary brush was used as the developer charge amount controlling means in the preceding embodiments, the choice of the developer charge amount controlling means does not need to be limited to a stationary brush. It may be a rotational brush, a sheet of electrically conductive substance, etc.

As described above, according to the present invention, an image forming apparatus employing a cleaner-less system, that is, a system which recovers the transfer residual developer (residual toner) remaining on the image bearing on the image bearing member after the image transfer process, by the developing means, in the developing station, at the same time as the developing process is carried out by the developing means, and which reuses the recovered transfer residual developer, comprises the combination of a developer particle uniformizing means (first developer charging member) and a developer charge amount controlling means (second developer charging member), for evenly redistributing the transfer residual developer particles across the peripheral surface of the image bearing member while controlling the triboelectrical charge of the developer particles, wherein the DC voltages applied to the two developer charging members are adjusted according to the environmental conditions affected by the temperature and relative humidity (moisture amount), which are detected by the temperature/humidity sensor disposed within the image forming apparatus, and also, according to the information regarding the printing ratio, so that the triboelectrical charge of the transfer residual developer particles is rectified in polarity and amount by the first and second developer charging means, making it possible for all the transfer residual developer particles to be recovered in the developing station by the developing apparatus at the same time as the developing process is carried out by the developing means. Therefore, the occurrence of image defects, in particular, the ghosts reflecting the transfer residual developer, is prevented.

More specifically, in the high temperature/high humidity environment, the voltages applied to the developer charging members are made slightly lower than the voltages applied thereto in the normal environment, preventing the developer charging members, the electrical resistance of which reduces due to the high humidity, from becoming excessive in charging performance, whereas in the low temperature/low humidity environment, the voltages applied to the developer charging members are made slightly higher than the voltages applied thereto in the normal environment, compensating for the decline in the charging performance of the developer charging members, which occurs due to the low temperature/low humidity. Therefore, the developer charging members are enabled to always properly charge the transfer residual developer, in polarity and amount.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

charging means for electrically charging said image bearing member, said charging means including a charging member disposed in contact with said image bearing member;

developing means for developing an electrostatic latent image formed on said image bearing member with a developer into a developed image;

transferring means for transferring the developed image from said image bearing member onto an image receiving member;

a first developer charging member for electrically charging a residual developer on said image bearing member, said first developer charging member being disposed downstream of said transferring means and upstream of said charging means, with respect to a movement direction of said image bearing member, and said first developer charging member being supplied with a voltage of a polarity opposite a regular polarity of the developer;

a second developer charging member for electrically charging the residual developer on said image bearing member to the regular polarity of the developer, said second developer charging member being disposed downstream of said first developer charging member and upstream of said charging means, with respect to the movement direction of said image bearing member, and said second developer charging member being supplied with a voltage;

means for detecting an environmental condition of said image forming apparatus; and controlling means for controlling, in accordance with an output of said detecting means, at least the voltage applied to said second developer charging member.

2. An image forming apparatus according to claim 1, wherein said controlling means controls the voltage applied to said first developer charging member means and the voltage applied to said second developer charging member in accordance with the output of said detecting means.

3. An image forming apparatus according to claim 1, wherein the voltage controlled by said controlling means is a DC voltage.

4. An image forming apparatus according to claim 1, wherein said first developer charging member charges the transfer residual developer to the polarity opposite the regular polarity of the developer.

5. An image forming apparatus according to claim 1, wherein said first developer charging member uniformizes amounts of charge of the residual developer.

6. An image forming apparatus according to claim 1, wherein said detecting means is a temperature/humidity sensor.

7. An image forming apparatus according to claim 6, wherein at least one the voltage applied to the first-and second developer charging member members is controlled in accordance with an absolute humidity detected by said temperature/humidity sensor.

8. An image forming apparatus according to claim 1, wherein said controlling means controls at least one of the voltages applied to said first and second developer charging members, in accordance with image formation data for forming an electrostatic latent image.

9. An image forming apparatus according to claim 8, wherein the image formation data is related to a ratio of a total illuminated area of the electrostatic latent image.

10. An image forming apparatus according to claim 1, wherein said first and second developer charging members are disposed in contact with said image bearing member.

11. An image forming apparatus according to claim 10, wherein said first and second developer charging members are in the form of a brush.

12. An image forming apparatus according to claim 1, wherein an AC voltage is applied to said charging member.

13. An image forming apparatus according to claim 1, wherein said developing means is capable of collecting the residual developer from said image bearing member simultaneously with a developing operation.

14. An image forming apparatus according to claim 1, wherein said image bearing member is a photoconductive member, and said image forming apparatus comprises exposing means for exposing said photoconductive member to form an electrostatic latent image on said photoconductive member charged by said charging means.

15. An image forming apparatus according to claim 1, wherein said charging member is supplied with a DC voltage of a polarity, which is the same as the regular polarity of the developer.

16. An image forming apparatus comprising:

an image bearing member;

charging means for electrically charging said image bearing member;

developing means for developing an electrostatic latent image formed on said image bearing member with a developer into a developed image;

transferring means for transferring the developed image from said image bearing member onto an image receiving member;

a first developer charging member for electrically charging a residual developer on said image bearing member, said first developer charging member being disposed downstream of said transferring means and upstream of said charging means, with respect to a movement direction of said image bearing member, and said first developer charging member being supplied with a voltage of a polarity opposite a regular polarity of the developer;

a second developer charging member for electrically charging the residual developer on said image bearing member to the regular polarity of the developer, said second developer charging member being disposed downstream of said first developer charging member and upstream of said charging means, with respect to the movement direction of said image bearing member, and said second developer charging member being supplied with a voltage; and controlling means for controlling, in accordance with image formation information for formation of the latent image, at least one of the voltages applied to said first and second developer charging members.

17. An image forming apparatus according to claim 16, herein said controlling means controls the voltage applied to said first developer charging member and the voltage applied to said second developer charging member, according to the image formation information.

18. An image forming apparatus according to claim 16, wherein the voltage controlled by said controlling means is a DC voltage.

19. An image forming apparatus according to claim 16, wherein said first developer charging member charges the residual developer to the polarity opposite the regular polarity of the developer.

20. An image forming apparatus according to claim 16, wherein said first developer charging member uniformizes amounts of charge of the residual developer.

21. An image forming apparatus according to claim 16, wherein the image formation information is related to a ratio of a total illuminated area of the electrostatic latent image.

22. An image forming apparatus according to claim 16, wherein said first and second developer charging members are disposed in contact with said image bearing member.

23. An image forming apparatus according to claim 22, wherein said first and second developer charging members are in the form of a brush.

24. An image forming apparatus according to claim 16, wherein said charging means comprises a charging member disposed in contact with said image bearing member.

25. An image forming apparatus according to claim 24, wherein an AC voltage is applied to said charging member.

26. An image forming apparatus according to claim 16, wherein said developing means is capable of collecting the residual developer from said image bearing member simultaneously with a developing operation.

27. An image forming apparatus according to claim 16, wherein said image bearing member is a photoconductive member, and said image forming apparatus comprises exposing means for exposing said photoconductive member to form an electrostatic latent image on said photoconductive member charged by said charging means.

* * * * *

UNITED STATES PATENT AND TRADEMARK OFFICE

CERTIFICATE OF CORRECTION

PATENT NO. : 6,744,994 B2
DATED : June 1, 2004
INVENTOR(S) : Tadanobu Yoshikawa et al.

It is certified that error appears in the above-identified patent and that said Letters Patent is hereby corrected as shown below:

Title page,
Item [57], ABSTRACT,
Line 9, “up stream” should read -- upstream --.

Column 1,
Line 49, “above described” should read -- above-described --; and
Line 66, “Image” should read -- image --.

Column 2,
Line 33, “above described” should read -- above-described --; and
Line 60, “charge” should read -- charge. --.

Column 3,
Line 38, “above described” should read -- above-described --; and
Line 45, “so that” (second occurrence) should be deleted.

Column 4,
Line 5, “above” should read -- above- --.

Column 9,
Line 42, “an” should read -- as --.

Column 10,
Line 29, “sourge S2 in” should read -- source S2. In --.

Column 11,
Line 44, “Thereafter” should read -- Thereafter, --; and
Line 45, “or” should read -- of --.

Column 12,
Line 38, “sourges” should read -- sources --.

Column 13,
Line 3, “above described” should read -- above-described --;
Line 8, “drum 1” should read -- drum 1. --; and
Line 25, “drum J” should read -- drum 1 --.

Column 14,
Lines 14 and 67, “above described” should read -- above-described --;
Line 65, “nut” should read -- not --; and

UNITED STATES PATENT AND TRADEMARK OFFICE

CERTIFICATE OF CORRECTION

PATENT NO. : 6,744,994 B2
DATED : June 1, 2004
INVENTOR(S) : Tadanobu Yoshikawa et al.

It is certified that error appears in the above-identified patent and that said Letters Patent is hereby corrected as shown below:

Column 15,
Line 12, “used” should read -- used. --.

Column 16,
Line 6, “7” should be deleted;
Lines 21, 59 and 63, “above described” should read -- above-described --; and
Line 25, “Voltage” should read -- voltage --;

Column 18,
Line 17, “0.6 $g/m^2$” should read -- 0.6 $g/m^2$. --.

Column 20,
Line 26, “station C,” should read -- station c, --;
Line 34, “is” should be deleted; and
Line 64, “sourges” should read -- sources --.

Column 21,
Lines 4 and 35, “above described” should read -- above-described --; and
Line 20, “sourges” should read -- sources --;
Line 48, “sourge” should read -- source --.

Column 25,
Line 27, “above described” should read -- above-described --; and
Line 50, “occurred” should read -- occur --.

Column 27,
Line 15, “above” should read -- above --.

Column 28,
Line 7, “above” should read -- above --;
Line 14, “sinusoldal,” should read -- sinusoidal, --;
Line 17, “sourge.” should read -- source. --;
Line 64, “one” should be deleted; and “first-and” should be deleted; and
Line 65, “members” should be deleted.

UNITED STATES PATENT AND TRADEMARK OFFICE

CERTIFICATE OF CORRECTION

PATENT NO. : 6,744,994 B2
DATED : June 1, 2004
INVENTOR(S) : Tadanobu Yoshikawa et al.

It is certified that error appears in the above-identified patent and that said Letters Patent is hereby corrected as shown below:

Column 29,
Line 47, “means” should be deleted.

Column 30,
Line 64, “herein” should read -- wherein --.

Signed and Sealed this

Twenty-first Day of September, 2004

JON W. DUDAS
*Director of the United States Patent and Trademark Office*